US009540996B2

(12) United States Patent
Kess et al.

(10) Patent No.: US 9,540,996 B2
(45) Date of Patent: Jan. 10, 2017

(54) SILENCER FOR EXHAUST SYSTEMS

(75) Inventors: Pamela Kess, Theres-Horhausen (DE); Roland Kess, Theres-Horhausen (DE)

(73) Assignee: KESSTECH GmbH, Obertheres (DE)

( * ) Notice: Subject to any disclaimer, the term of this patent is extended or adjusted under 35 U.S.C. 154(b) by 290 days.

(21) Appl. No.: 13/990,943

(22) PCT Filed: Dec. 2, 2011

(86) PCT No.: PCT/EP2011/071603

§ 371 (c)(1),
(2), (4) Date: May 31, 2013

(87) PCT Pub. No.: WO2012/072789

PCT Pub. Date: Jun. 7, 2012

(65) Prior Publication Data

US 2013/0247865 A1 Sep. 26, 2013

(30) Foreign Application Priority Data

Dec. 2, 2010 (DE) ..... 10 2010 062 366
Dec. 23, 2010 (DE) ..... 10 2010 064 088

(51) Int. Cl.
*F01N 1/16* (2006.01)
*F02B 77/00* (2006.01)
*F01N 9/00* (2006.01)

(52) U.S. Cl.
CPC ..... *F02B 77/00* (2013.01); *F01N 1/163* (2013.01); *F01N 1/166* (2013.01); *F01N 9/00* (2013.01)

(58) Field of Classification Search
CPC ..... F02B 77/00; F01N 1/00; F01N 1/003; F01N 1/006; F01N 1/085; F01N 1/08; F01N 1/16; F01N 1/165; F01N 1/166; F01N 1/18; F01N 1/163
See application file for complete search history.

(56) References Cited

U.S. PATENT DOCUMENTS 1,613,322 A * 1/1927 Goetz ..... 181/254
2,157,030 A 5/1939 Starkweather et al.
6,336,321 B1 * 1/2002 Sagara et al. ..... 60/324
6,546,722 B2 4/2003 Sagara et al.
7,484,591 B2 2/2009 Kess
(Continued)

FOREIGN PATENT DOCUMENTS

DE 94 06 200 U1 5/1994
DE 100 02 593 A1 7/2000
(Continued)

*Primary Examiner* — Jacob Amick
(74) *Attorney, Agent, or Firm* — McGlew and Tuttle, P.C.

(57) ABSTRACT

The invention relates to a silencer for exhaust systems of motor vehicles with an internal combustion engine. The silencer includes an exhaust gas flow pipe for guiding exhaust gas with an exhaust gas inlet opening, an exhaust gas outlet opening having a flow connection to the exhaust gas inlet opening, and a longitudinal center axis. It furthermore has at least one actuable adjustment body for influencing the flow of the exhaust gas in the exhaust gas flow gas pipe, the at least one adjustment body being arranged downstream of the exhaust gas inlet opening. Moreover, the silencer includes at least one bypass channel, which has a flow connection to the exhaust gas flow pipe, runs past the at least one adjustment body and has an exhaust gas outlet opening.

22 Claims, 24 Drawing Sheets

(56) References Cited

U.S. PATENT DOCUMENTS

| | | | | |
|---|---|---|---|---|
| 2006/0000205 | A1 | 1/2006 | Bozmoski et al. | |
| 2011/0000201 | A1* | 1/2011 | Laube et al. | 60/324 |

FOREIGN PATENT DOCUMENTS

| | | | |
|---|---|---|---|
| DE | 20 2005 011 448 | U1 | 11/2006 |
| JP | 2004 225 643 | A | 8/2004 |
| WO | 99/25962 | A1 | 5/1999 |

* cited by examiner

SILENCER FOR EXHAUST SYSTEMS

CROSS REFERENCE TO RELATED APPLICATIONS

This application is a United States National Phase Application of International Application PCT/EP2011/071603 and claims the benefit of priority under 35 U.S.C. §119 of German Patent Application Serial No. 10 2010 062 366.0 filed Dec. 2, 2010 and German Patent Application Serial No. 10 2010 064 088.3 filed Dec. 23, 2010, the entire contents of which are incorporated herein by reference.

FIELD OF THE INVENTION

The invention relates to a silencer for exhaust systems of motor vehicles with an internal combustion engine. The invention is also directed at a silencer arrangement with at least one corresponding silencer, which is provided for exhaust systems of motor vehicles with an internal combustion engine. The internal combustion engine may be a diesel engine or petrol engine.

BACKGROUND OF THE INVENTION

Exhaust systems of motor vehicles have to adhere to legally prescribed sound emission limit values. In the framework of the legally prescribed noise emission limit values, for example, a maximum volume of the exhaust system is in general desired for motor cyclists when traveling. The legally prescribed noise emission limit values are not fixed uniformly worldwide, so an expensive adaptation to the noise emission limit values prevailing locally, in each case, is required for exhaust systems provided for export.

Various silencers for exhaust systems are known from DE 20 2005 011 448 U1. These silencers have proven successful in practice.

SUMMARY OF THE INVENTION

The invention is based on an object of providing a silencer, which allows an extremely precise setting of the volume of the exhaust system. Furthermore, the silencer is to be particularly simple in configuration and have a high functional reliability. A corresponding silencer arrangement is also to be provided.

This object is achieved according to the invention by a silencer for exhaust systems of motor vehicles with an internal combustion engine, comprising an exhaust gas flow pipe for guiding exhaust gas with at least one exhaust gas inlet opening, at least one exhaust gas outlet opening, which has a flow connection to the at least one exhaust gas inlet opening, and a longitudinal center axis, at least one actuable adjustment body to influence the flow of the exhaust gas in the exhaust gas flow pipe, wherein the at least one adjustment body is arranged downstream of the at least one exhaust gas inlet opening, and is movable between an open position and a closed position, and at least one bypass channel, which has a flow connection to the exhaust gas flow pipe, and has at least one exhaust gas outlet opening, and by a silencer arrangement for exhaust systems of motor vehicles with an internal combustion engine, comprising at least one such silencer.

The silencer according to the invention is provided for exhaust systems of motor vehicles. Motor vehicles are taken to mean here motor-driven vehicles. Motor vehicles include, for example, motorcycles, private cars, lorries, motorbuses, towing vehicles and special-purpose motor vehicles.

The silencer may be a rear or middle silencer.

The exhaust gas flow pipe is preferably circular ring-shaped in cross-section. The exhaust gas flow pipe may, however, also have any other de-sired cross-sections, such as an oval cross-section. It is preferably peripherally perforated, at least in regions, and can be connected to an internal combustion engine. A catalyst for exhaust gas post-treatment may be associated with the internal combustion engine. However, there may also be no catalyst associated with the internal combustion engine.

The flow of the exhaust gas in the exhaust gas flow pipe can be influenced by the at least one actuable adjustment body. For example, the at least one adjustment body may allow a flow of the exhaust gas in the exhaust gas flow pipe or completely prevent it. The at least one adjustment body may, however, also influence the flow speed of exhaust gas in the exhaust gas flow pipe. The exhaust gas flow and exhaust gas counter-pressure can, for example, be varied by the at least one adjustment body, which also has an effect on the power and the torque of the internal combustion engine. The at least one adjustment body can preferably be continuously adjusted.

A damping can take place in at least one bypass channel by resonance, ab-sorption, interference, throttle configuration (cross-sectional constriction), perforation of at least one part region of a bypass body limiting the bypass channel and/or reflection, combinations also being possible. The at least one bypass channel may comprise one or more flow chambers. If a plurality of flow chambers is provided, these are preferably connected in series.

It is advantageous if the at least one bypass channel extends, at least in regions, parallel to the exhaust gas flow pipe. The at least one bypass channel preferably extends, at least in regions, along the exhaust gas flow pipe. This configuration leads to an extremely compact and economical silencer. This silencer, in particular, has an extremely short length. Advantageously, this silencer also has an extremely small transverse dimension or an extremely small diameter.

Advantageously, the at least one bypass channel runs in a meandering manner, at least in regions. The at least one bypass channel is then extremely long. It has a plurality of exhaust gas deflection points.

The at least one bypass channel is advantageously limited by at least one bypass body, which is preferably tubular. The bypass body can be configured as a separate insert. It is preferably tubular, any cross-sections being possible.

The at least one bypass body advantageously has at least one exhaust gas inlet opening, by means of which the at least one bypass body has a flow connection to the exhaust gas flow pipe.

The at least one exhaust gas inlet opening is preferably provided peripherally in the at least one bypass body. It is preferably provided in the casing of the at least one bypass body. The exhaust gas inlet opening is thus oriented obliquely with respect to the main flow direction of the exhaust gas in the exhaust gas flow pipe.

The at least one exhaust gas inlet opening is advantageously provided up-stream on the end face in the at least one bypass body. The exhaust gas inlet opening is therefore open in the main flow direction of the exhaust gas in the exhaust gas flow pipe.

Advantageously, an exhaust gas outlet opening of the exhaust gas flow pipe and an exhaust gas outlet opening of the bypass channel are arranged adjacently with respect to one another. These may be provided one above the other or next to one another.

It is advantageous if the exhaust gas flow pipe and the at least one bypass body have a flow connection to one another by means of at least one coupling pipe section. The coupling pipe section may be arranged upstream and/or downstream of the exhaust gas flow pipe and/or the bypass channel.

It is advantageous if the exhaust gas flow pipe and the at least one bypass channel are surrounded, at least in regions, by an absorption material. Steel wool or stainless steel wool, basalt fibers, fiber glass mats or threads or the like may be used as the absorption material.

The absorption material is advantageously surrounded, at least in regions, by a silencer housing. The silencer housing may be circular ring-shaped or oval in cross-section. However, it may also have other cross-sectional shapes.

The at least one adjustment body is preferably arranged in the exhaust gas flow pipe. It may be located on the inlet side or outlet side in the exhaust gas flow pipe. However, it may also be arranged in a region which is located between, preferably approximately centrally between, the exhaust gas inlet opening and the exhaust gas outlet opening.

By the at least one adjustment body being arranged directly downstream of the exhaust gas flow pipe, the at least one adjustment body is provided outside the exhaust gas flow pipe.

It is advantageous if the silencer is configured in such a way that the exhaust gas, at least in regions, flows transverse to the longitudinal center axis in the exhaust gas flow pipe, in order to arrive at the least one bypass channel. The at least one bypass channel is preferably arranged radially offset with respect to the longitudinal center axis.

The exhaust gas flow pipe being configured in such a way that exhaust gas can flow straight through the latter in the direction of the longitudinal center axis if the at least one adjustment body (8; 8*g*; 8*h*; 8*i*) is in its open position has an extremely small flow resistance. It is preferably free of exhaust gas deflection points. It is, in particular, configured in such a way that, when the adjustment body is open, the exhaust gas can flow straight and substantially barrier-free through the exhaust gas flow pipe in the direction of the longitudinal center axis. If the exhaust gas flow pipe is circular in cross-section, the exhaust gas flows axially.

The configuration, in which at least one exhaust gas guide element, which is arranged in the exhaust gas flow pipe and runs at least partially along it and which has at least one exhaust gas through-opening and limits at least one outer expansion chamber, wherein at least one bypass body preferably runs, at least in regions, in the at least one outer expansion chamber, pro-duces a particularly good exhaust gas guidance in the exhaust gas flow pipe. The exhaust gas guide element may be configured as a pipe, plate or bend.

The cap body, in which at least one exhaust gas inlet opening of the bypass body is covered, at least in regions, by at least one cap body arranged spaced apart, is preferably closed upstream.

Advantageously, the at least one adjustment body is configured as an adjustment flap, which can be pivoted between an open position and a closed position. The pivoting movement of the at least one adjustment flap may be locally limited. For this purpose, corresponding end stops may be used, which prevent a further pivoting of the at least one adjustment body. The at least one adjustment body is accordingly pivotably mounted. The pivoting axis of the at least one adjustment flap can run obliquely, preferably perpendicularly, with respect to the longitudinal center axis or preferably in the direction thereof.

The at least one bypass channel may run past the at least one adjustment body.

It is advantageous if the at least one bypass channel runs laterally out of the silencer housing.

It may open upstream or adjacent to the at least one adjustment body laterally into the surroundings or into a further silencer, an interference pipe or a complete pot.

The presetting of the control device, in which a control device, which has a connection, so as to transmit data, to the at least one adjustment body for the actuation thereof, and at least one adjustment drive, which can be actuated by the control device, to adjust the at least one adjustment body, wherein the control device, depending on at least one preset threshold value, preferably automatically actuates the at least one adjustment body, can be achieved, for example, by a corresponding programming. It is advantageous if the at least one adjustment drive is an electric adjustment drive. A motor vehicle speed threshold value and/or an engine speed threshold value can be used as the preset threshold value. The threshold value may also be a gear threshold value. The control device may actuate the at least one adjustment body if the threshold value is fallen below or exceeded. The control device is preferably an electronic control device.

An automatic adjustment takes place owing to the configuration, in which the adjustment of the at least one adjustment body is limited by at least one stop, the control device receiving a stop signal on reaching the at least one stop. A personal adjustment is thus unnecessary. It is advantageous if the adjustment drive is an electric adjustment drive and the control device is configured in such a way that, as a stop signal, it detects a current increase of the electric adjustment drive and thus switches off the electric adjustment drive. Mechanical play can thus be effectively and easily compensated. The current increase can be produced in such a way that the electric adjustment drive, in a closed position of the at least one adjustment body, is counteracted by a mechanical resistance. For this purpose, at least one cor-responding end stop can be provided. The end stop can then directly inter-act with the adjustment body and/or the electric adjustment drive. How-ever, it can also virtually be produced by the at least one adjustment body itself. The adjustment drive may, however, also be configured in such a way that the respective opening or closing angle is effected without at least one corresponding end stop. In the case of a pneumatic or hydraulic activation, the corresponding electronic connections to the control device, which receive the commands to adjust the at least one adjustment body, then have to be produced.

Alternatively, the control device may be configured in such a way that, instead of the current increase, it detects a switch-off time signal and switches off the adjustment drive in a time-controlled manner. For this purpose, a corresponding switch-off time is to be programmed in advance into the control device.

It is advantageous if a silencer arrangement comprises at least two silencers connected in series, at least two of the silencers preferably having a flow connection to one another by means of at least one exhaust gas interference pipe. The exhaust gas interference pipe may be configured as an exhaust pipe holder.

Alternatively, the silencer arrangement may also comprise only one silencer, which is equipped with at least one bypass channel.

Advantageously, the at least one adjustment body is in its closed position when the motor vehicle is idling. The control device is preferably set or programmed for this accordingly. The adjustment drive may bring the at least one adjustment body into its closed position.

Alternatively or additionally, the at least one adjustment body is advantageously closed again from a predetermined engine speed, the engine speed preferably being to be set or to be programmed depending on the vehicle. The adjustment drive thus preferably optionally moves the at least one adjustment body into its closed position. The latter preferably receives for this a corresponding closing or switch-off time signal from the control device.

The control device is preferably configured in such a way that it produces, in at least one preset speed interval and/or engine speed interval, an opening signal to partly or completely open the at least one adjustment body.

The control device being configured in such a way that when at least one threshold value is preset, it actuates the adjustment drive in such a way that the at least one adjustment body only opens to reduce the exhaust gas counter-pressure to such an extent that predetermined vehicle values are retained makes a bypass channel possible, which is extremely short and/or has a particularly small effective flow cross-section. It preferably opens the at least one adjustment body at at least one defined speed, rotational speed and/or at least one defined gear of the motor vehicle. This at least one threshold value is preferably programmed or stored in the control device. By opening the at least one adjustment body, the exhaust gas counter-pressure can be reduced. It is advantageous if the control device is configured in such a way that it opens the at least one adjustment body only just to such an extent that despite the small bypass channel, the values given by the motor vehicle producer, such as the engine power and/or torque, can be retained and/or improved.

Alternatively, the control device can also be configured in such a way that it also just opens the at least one adjustment body, in a deactivated state, to such an extent that, despite the small bypass channel, the values given by the motor vehicle producer, such as engine power and/or torque and/or all the legal EEC specifications can be retained and/or improved. This mode of functioning of the control device in the deactivated state applies to all the adjustment bodies disclosed in the embodiments, which may differ with respect to their form, dimension or arrangement in the silencer.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 21 a is a sectional view of an adjustment body in a closed position and an associated adjustment body receiver;

DESCRIPTION OF THE PREFERRED EMBODIMENTS

Figure 1:
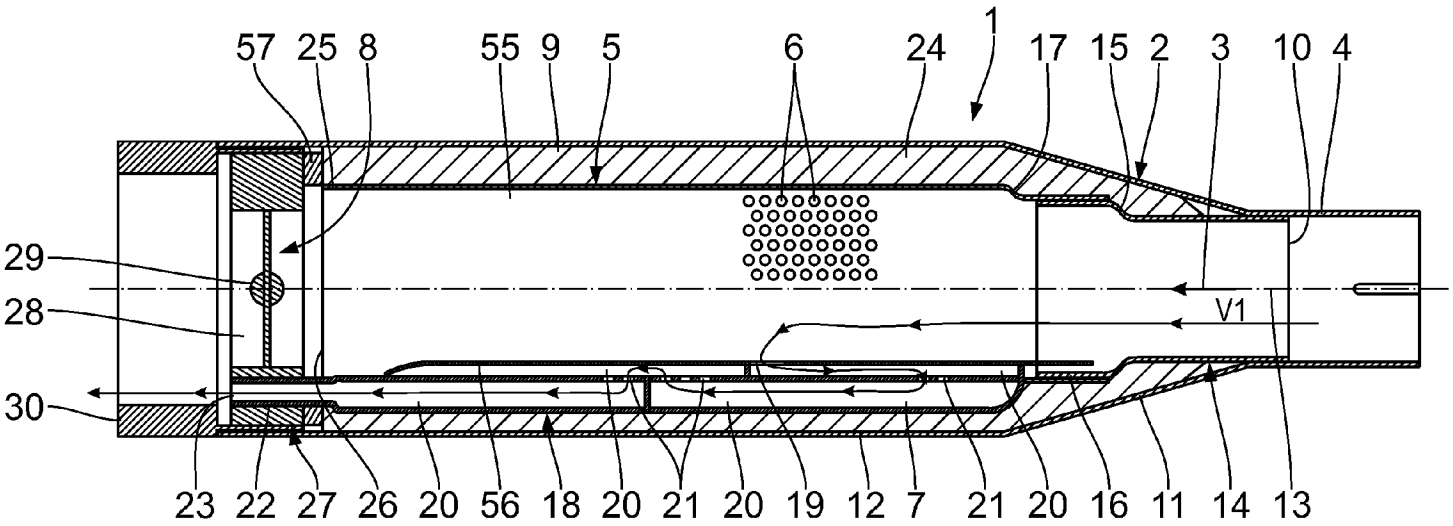
FIG. 1 is a longitudinal sectional view through a silencer according to the invention according to a first embodiment, the adjustment body being in a closed position.

With reference to FIGS. 1 to 4, a first embodiment of the invention will be described below. A silencer 1 for use in exhaust systems of motor vehicles, in particular motorcycles, has a silencer housing 2, which preferably tapers counter to a main flow direction 3 of exhaust gas and is rigidly connected to a connection piece 4. The silencer housing 2 may, however, also have a corresponding different geometric shape. The connection piece 4 can be attached to a combustion engine of a motor vehicle or another silencer 1. The silencer housing 2 and the connection piece 4 may be configured in one piece or as separate components. Arranged within the silencer housing 2 is an exhaust gas flow pipe 5, which runs straight, peripherally has perforation openings 6, at least in regions, and laterally delimits an exhaust gas flow channel 55. Furthermore, a bypass channel 7, which has a flow connection to the exhaust gas flow pipe 5 or the exhaust gas flow channel 55 and substantially runs along the latter, extends at the edge in the silencer housing 2. Downstream of the exhaust gas flow pipe 5, an adjustment body 8 is mounted in the silencer housing 2 and is movable between an open position and a closed position. An absorption material 9 adjoins the silencer housing 2 on the inside.

Figure 3:
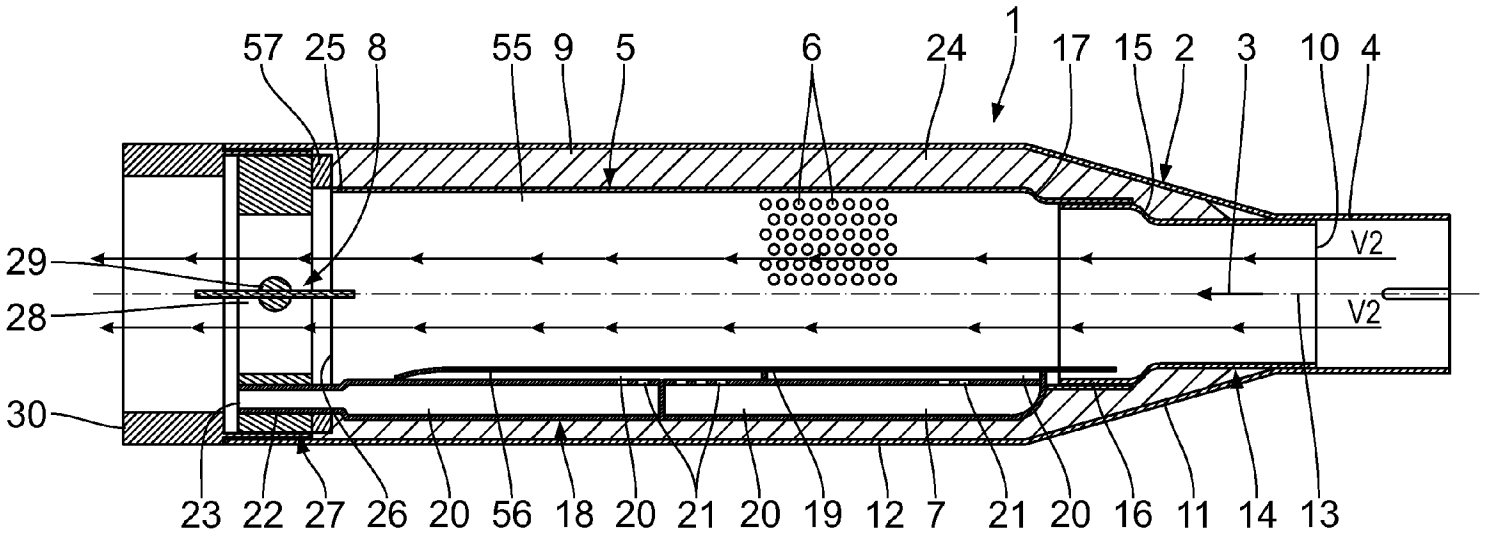
FIG. 3 is a longitudinal sectional view of the silencer shown in FIG. 1, the adjustment body being in an open position here.
Figure 4:
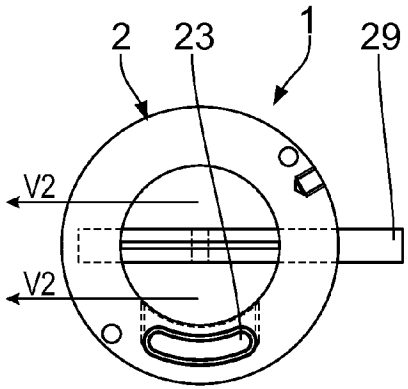
FIG. 4 is a schematic view which shows the silencer shown in FIG. 3 from behind.
Figure 5:
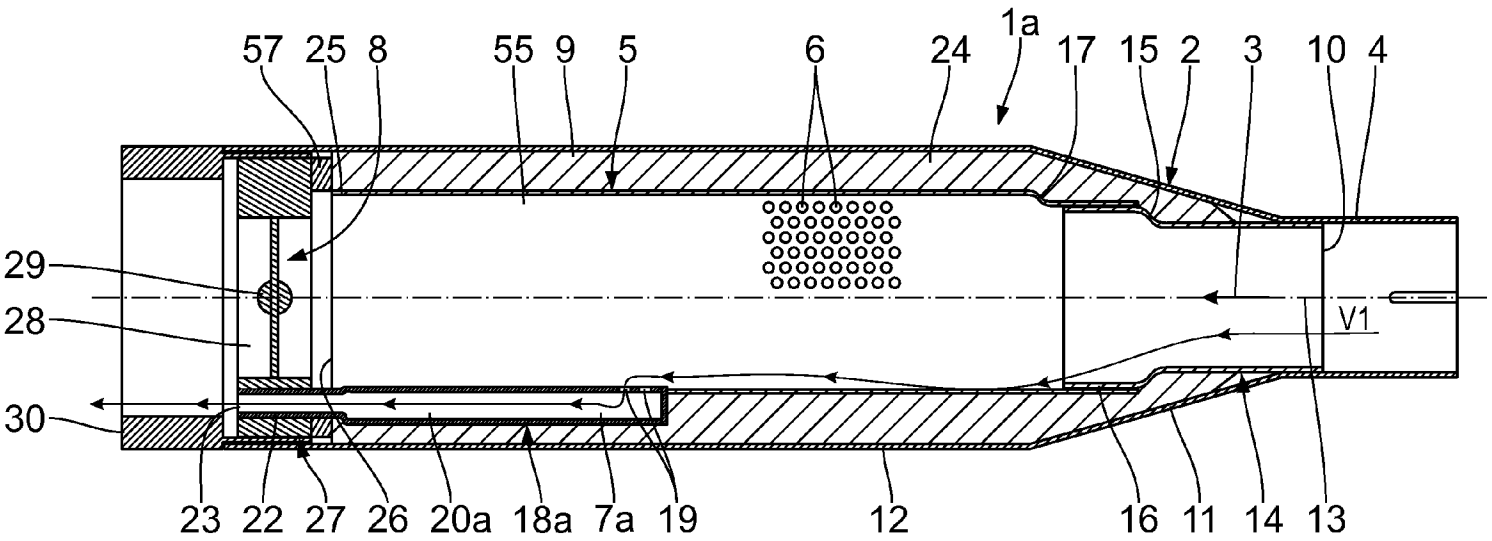
FIG. 5 is a longitudinal sectional view through a silencer according to the invention according to a second embodiment, the adjustment body being in a closed position.
Figure 6:
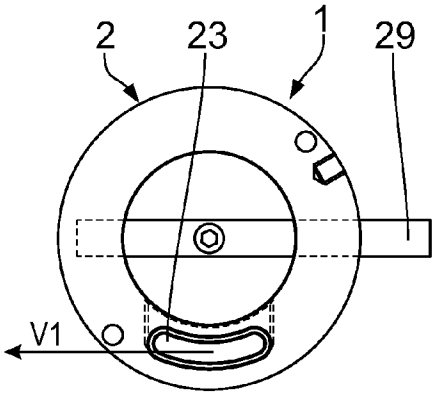
FIG. 6 is a schematic view which shows the silencer shown in FIG. 5 from the rear.
Figure 7:
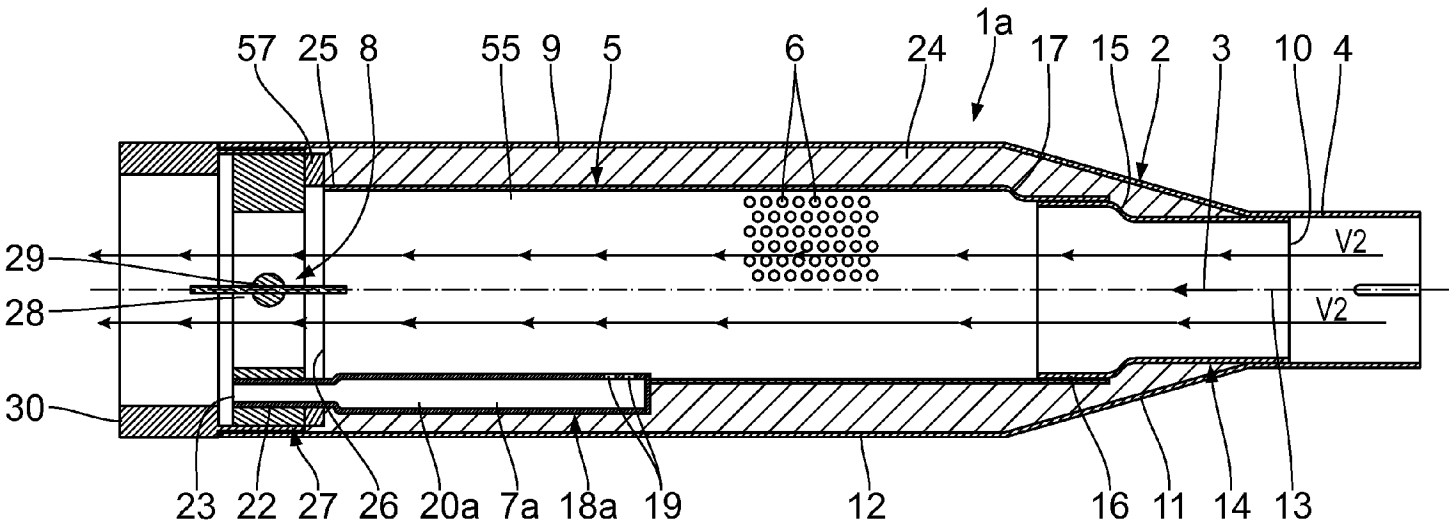
FIG. 7 is a longitudinal sectional view of the silencer shown in FIG. 5, the adjustment body being in an open position.
Figure 8:
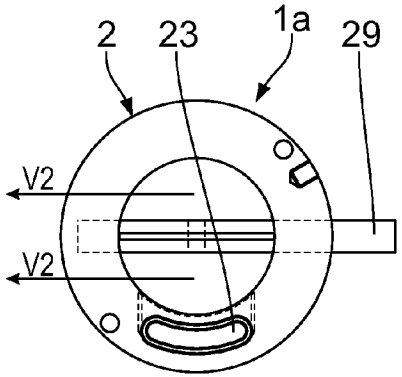
FIG. 8 is a schematic view which shows the silencer shown in FIG. 7 from the rear.

When the adjustment body 8 is in its open position (see FIGS. 3, 4), the exhaust gas flows out of the connection piece 4 in the main flow direction 3 axially through the exhaust gas flow pipe 5 and passes the adjustment body 8. This is illustrated in FIGS. 3, 4 by the flow arrow V2. No or hardly any exhaust gas flows from the exhaust gas flow pipe 5 into the bypass channel 7 here.

Figure 2:
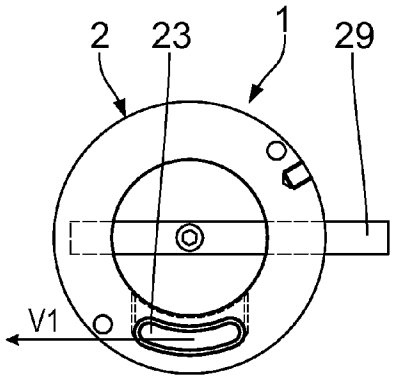
FIG. 2 is a schematic view which shows the silencer shown in FIG. 1 from the rear.

When the adjustment body 8 is in its closed position (see FIGS. 1, 2), the exhaust gas flows via the connection piece 4 in the main flow direction 3 into the exhaust gas flow pipe 5 and then laterally enters the bypass channel 7. In the bypass channel 7, the exhaust gas is deflected, so the bypass channel 7 has a predetermined flow length. The exhaust gas leaves the silencer 1 via the bypass channel 7, which runs past the adjustment body 8. This is illustrated in FIGS. 1, 2 by the flow arrow V1. The noise produced is strongly damped here by the bypass channel 7.

The connection piece 4 is circular ring-shaped in cross-section and preferably has a constant diameter.

The silencer housing 2 is also circular ring-shaped in cross-section. Adjacent to the connection piece 4, the silencer housing 2 advantageously has a widening region 11, in which the silencer housing 2 is widened in the main flow direction 3. The silencer housing 2 in the widening region 11 preferably widens continuously or conically. A main region 12, which is a component of the silencer housing 2, advantageously adjoins the widening region 11 downstream. In the main region 12, the silencer housing 2 preferably has a constant diameter. The silencer housing 2 has a longitudinal center axis 13, which extends in the direction of the main flow direction 3.

The exhaust gas flow pipe 5 is circular ring-shaped in cross-section. It is accommodated substantially concentrically with respect to the longitudinal center axis 13 in the silencer housing 2 and has an inlet piece 14, which adjoins the connection piece 4 downstream. The inlet piece 14 has an exhaust gas inlet opening 10 on the inlet side. It substantially extends along the widening region 11. The inlet piece 14, according to this embodiment, preferably has a annular shoulder 15. In the region of the annular shoulder 15, the exhaust gas flow pipe 5 widens in the main flow direction 3. The exhaust gas flow pipe 5 may, however, also be fastened without an inlet piece 14 to the silencer housing 2.

The inlet piece 14 has a downstream end 16. Adjacent to the end 16 of the inlet piece 14, the exhaust gas flow pipe 5 has a annular shoulder 17. In the region of the annular shoulder 17, the exhaust gas flow pipe 5 widens in the main flow direction 3. Downstream of the annular shoulder 17, the exhaust gas flow pipe 5 has a constant cross-section. The inlet piece 14 may be configured separately.

In the silencer housing 2, an elongate bypass body 18 is accommodated, which determines the course of the bypass channel 7 and projects laterally into the exhaust gas flow pipe 5. The bypass body 18 extends in the main flow direction 3 or parallel to the longitudinal center axis 13. It is located in a peripheral edge region of the exhaust gas flow pipe 5. The bypass body 18 is curved in cross-section. The curvature center of the bypass body 18 preferably coincides substantially with the longitudinal center axis 13. It is advantageous if the bypass body 18 extends over an angular range of 5° to 120°, preferably 50° to 90°, in relation to the longitudinal center axis 13.

The bypass body 18 has at least one, preferably a plurality of, inner exhaust gas inlet openings 19, which have a direct flow connection to the exhaust gas flow pipe 5. The exhaust gas inlet openings 19 are provided on the in-side 56 of the bypass body 18. The exhaust gas flow channel 55 is radially outwardly limited by the inside 56. The exhaust gas inlet openings 19 are located in a front region of the bypass body 18.

A plurality of flow chambers 20, which are connected in series and have a flow connection to one another by means of corresponding connecting openings 21, are provided in the bypass body 18. The flow chambers 20 are arranged in such a way that, when there is flow through them, the exhaust gas is repeatedly deflected. The last flow chamber 20 has an exhaust gas outlet body 22 with an exhaust gas outlet opening 23 and runs parallel to the exhaust gas flow pipe 5. It can be configured in a nozzle-like manner. The exhaust gas outlet body 22 runs past the adjustment body 8. The exhaust gas outlet opening 23 is located downstream of the adjustment body 8.

An annular intermediate space 24, in which the absorption material 9 is arranged, is located between the silencer housing 2 and the exhaust gas flow pipe 5 or the bypass body 18.

The exhaust gas flow pipe 5 ends in the main flow direction 3 before the silencer housing 2. In the region of the downstream end 25 of the exhaust gas flow pipe 5, the exhaust gas flow pipe 5 has an exhaust gas outlet opening 26, which is substantially larger than the exhaust gas outlet opening 23 of the bypass body 18 and also larger than the exhaust gas inlet opening 10. The absorption material 9 also ends in the region of the end 25.

Downstream of the end 25, an adjustment body receiver 27 is provided in the silencer housing 2, which is circular ring-shaped in cross-section and is arranged concentrically with respect to the longitudinal center axis 13. A sealing ring 57 may be arranged between the absorption material 9 and the adjustment body receiver 27. The adjustment body receiver 27 limits an exhaust gas through-channel 28, in which the adjustment body 8 is accommodated so as to be actuable.

The adjustment body 8 is formed by a cross-sectionally circular flap, the diameter of which approximately corresponds to the inner diameter of the adjustment body receiver 27. The adjustment body 8 has a non-rotatable connection to a bearing body 29, which is pivotably mounted in the adjustment body receiver 27 and can be pivoted by applying an external pivoting force. The bearing body 29 is preferably configured in the manner of a pin. It extends perpendicular to the main flow direction 3 or the longitudinal center axis 13. The exhaust gas outlet body 22 passes through the adjustment body receiver 27.

An end piece 30, which is circular ring-shaped in cross-section and is arranged concentrically with respect to the longitudinal center axis 13, adjoins the silencer housing 2 downstream of the adjustment body 8.

The function of the silencer 1 in operation will be described in detail below. In this case, the operation of the silencer 1 when the adjustment body 8 is closed according to FIGS. 1, 2 will firstly be dealt with. The exhaust gas leaving the internal combustion engine of the motor vehicle arrives via the connection piece 4 in the exhaust gas flow pipe 5. Once the adjustment body 8 is in its closed position and thus completely closes the exhaust gas through-channel 28 in the adjustment body receiver 27, the exhaust gas flows via the exhaust gas inlet openings 19 laterally into the bypass body 18 (arrow V1). The exhaust gas in this case also flows transverse to the main flow direction 3. The exhaust gas flows via the connecting openings 21 through the individual flow chambers 20 and is repeatedly deflected here. The bypass body 18 thus forms a multi-chamber body. The exhaust gas then passes the adjustment body 8 in the exhaust gas outlet body 22 and thus arrives via the end piece 30 in the surroundings. The entire exhaust gas flows via the exhaust gas outlet opening 23 into the surroundings. No exhaust gas can arrive in the surroundings via the exhaust gas outlet opening 26. The adjustment body 8, in its closed position, is perpendicular to the main flow direction 3 or to the longitudinal center axis 13.

If the adjustment body 8, on the other hand, is in its open position according to FIGS. 3, 4, the exhaust gas through-channel 28 is freed. The adjustment body 8 is pivoted here relative to its closed position by about 90° about the bearing body 29. The pivoting movement preferably takes place by motor. The exhaust gas can thus completely flow through the exhaust gas flow pipe 5 axially and thus also pass through the exhaust gas through-channel 28 (arrow V2). It then leaves the silencer 1 by means of the end piece 30. The exhaust gas through-channel 28, depending on the engine speed and/or the speed of the motor vehicle, may also only be partially opened.

With reference to FIGS. 5 to 8, a second preferred embodiment of the invention will be described below. Identical components receive the same reference numerals as the previous embodiment, to which reference is hereby made. Structurally different, but functionally similar components receive the same reference numerals with an "a" thereafter. This also applies analogously to the further embodiments.

The silencer 1*a* according to the second embodiment differs from the silencer 1 according to the first embodiment only by the bypass body 18*a*. The bypass body 18*a* has only precisely one flow chamber 20*a*. It thus forms a single-chamber body. The exhaust gas outlet body 22 again runs past the adjustment body 8. The bypass channel 7*a* thus extends substantially parallel to the exhaust gas flow channel 55.

Figure 9:
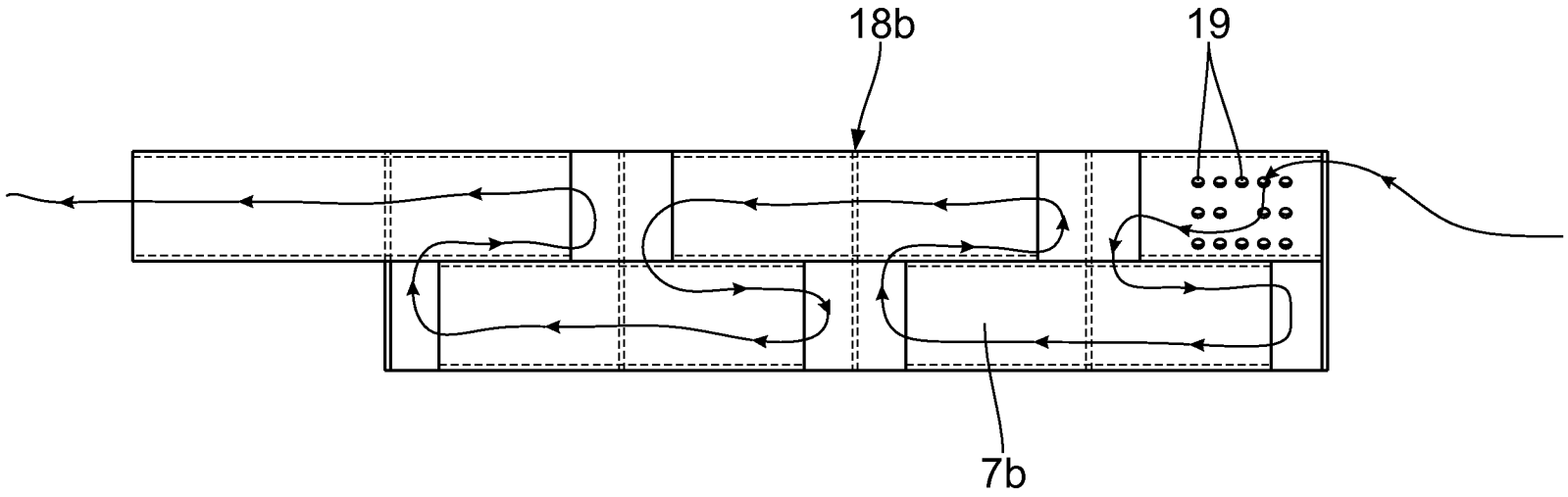
FIG. 9 is a schematic view which shows a possible course of the bypass channel.

FIG. 9 shows a bypass body 18*b*, which predetermines a flow channel 7*b* for exhaust gas. The flow channel 7*b* runs in a meandering manner. A re-flection silencer is thus provided. The bypass body 18*b* can be used in the silencers 1, 1*a* according to the described embodiments.

Figure 10:
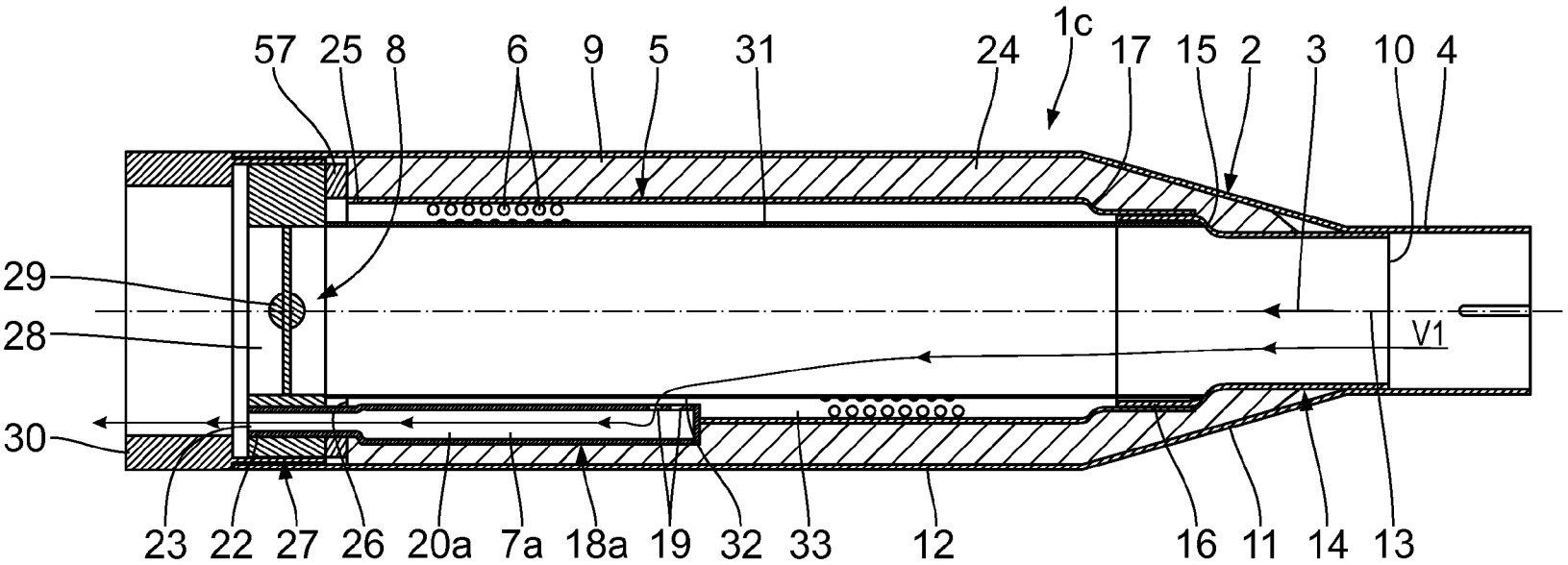
FIG. 10 is a longitudinal sectional view through a silencer according to the invention according to a third embodiment, the adjustment body being in a closed position here.
Figure 11:
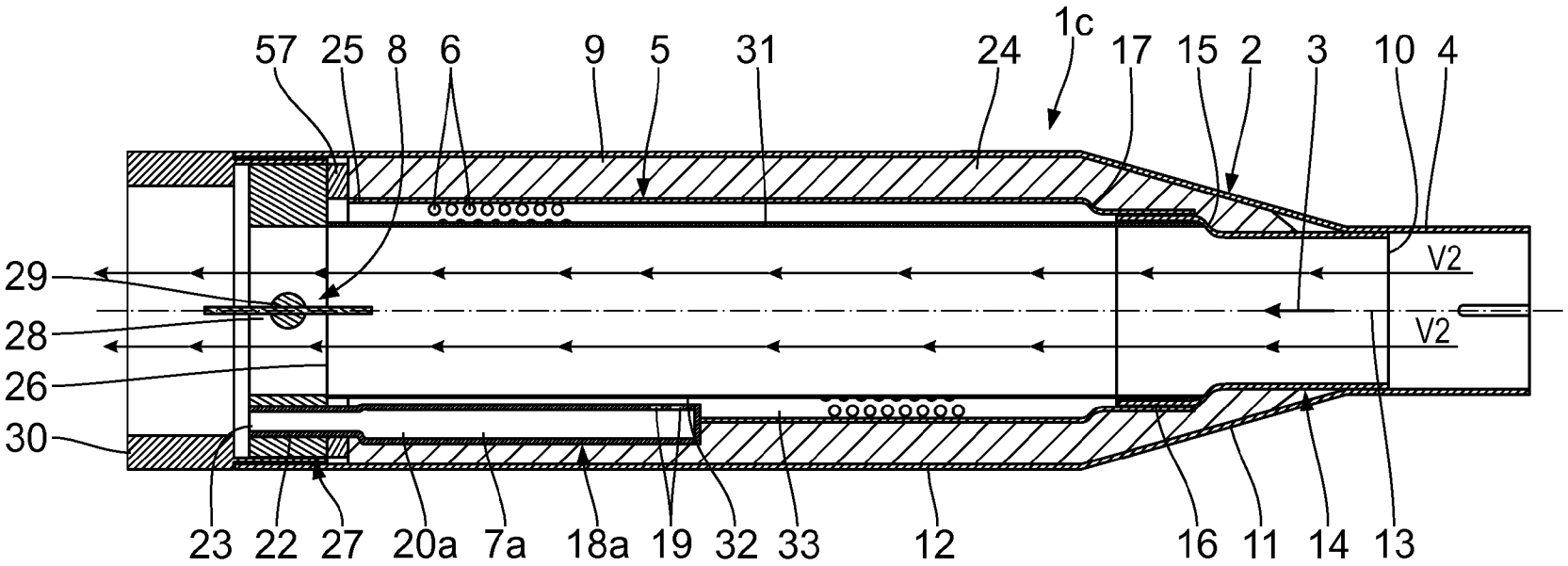
FIG. 11 is a longitudinal sectional view of the silencer shown in FIG. 10, the adjustment body being in an open position here.

With reference to FIGS. 10 and 11, a third embodiment of the invention will be described below. The silencer 1*c* is similar to the silencer 1*b* according to the second embodiment. In contrast to the silencer 1*b*, the silencer 1*c* additionally has a straight inner pipe 31, which is circular ring-shaped in cross-section and is arranged concentrically with respect to the longitudinal center axis 13. The inner pipe 31 extends from the annular shoulder 15 up to the adjustment body receiver 27. It runs spaced apart from the exhaust gas flow pipe 5. The inner pipe 31, at least in the region of the exhaust gas inlet openings 19, has at least one lateral exhaust gas through-opening 32. The adjustment body 8 is arranged downstream of the inner pipe 31. By means of the inner pipe 31, a second, outer expansion chamber is virtually provided or inwardly limited, in which the exhaust gas can expand and can be calmed down. In the inner pipe 31, the exhaust gas can flow through the exhaust gas through-openings 32 extremely favorably in terms of flow and rapidly.

When, according to FIG. 10, the adjustment body 8 is in its closed position, the exhaust gas coming from the internal combustion engine flows via the exhaust gas through-openings 32 into the bypass body 18*a*. The exhaust gas also flows transverse to the main flow direction 3 here. It leaves the bypass body 18*a* through the exhaust gas outlet body 22. The exhaust gas, after passing through the exhaust gas through-openings 32, can also arrive in an annular space 33, which is present between the exhaust gas flow pipe 5 and the inner pipe 31.

If, on the other hand, the adjustment body 8 according to FIG. 11 is in its open position, the exhaust gas flows through the inner pipe 31. It then flows by means of the exhaust gas through-channel 28 into the end piece 30. The exhaust gas flows here primarily past the exhaust gas through-openings 32 of the inner pipe 31.

Figure 12:
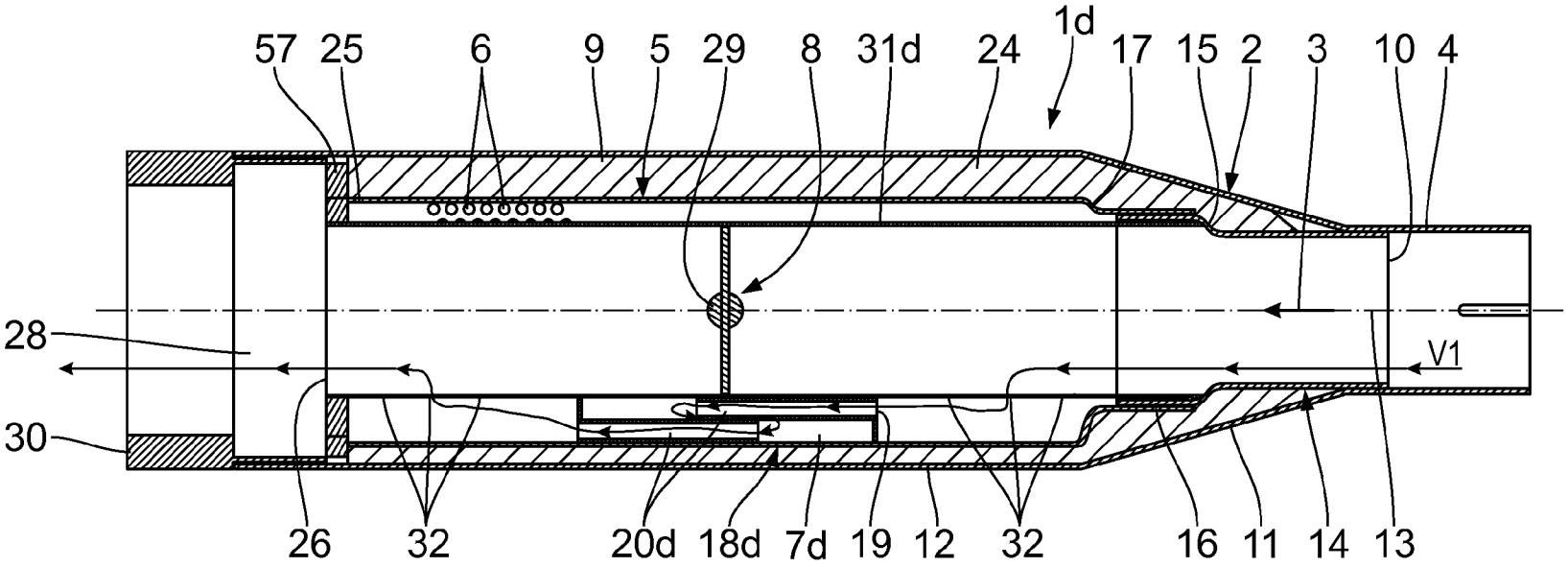
FIG. 12 is a longitudinal sectional view through a silencer according to the invention according to a fourth embodiment, the adjustment body being in a closed position here.
Figure 13:
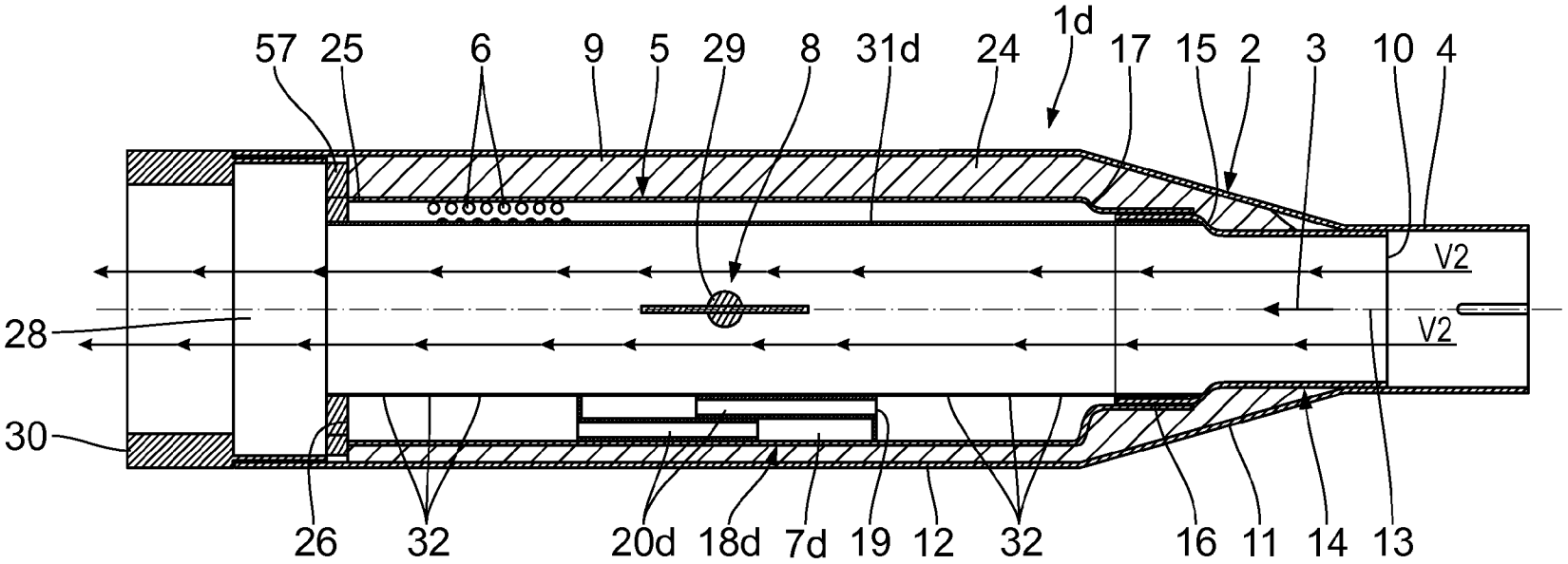
FIG. 13 is a longitudinal sectional view of the silencer shown in FIG. 12, the adjustment body being in an open position here.

With reference to FIGS. 12 and 13, a fourth embodiment of the invention will be described below. This embodiment is similar to the embodiment according to FIGS. 10 and 11. The exhaust gas through-openings 32 in the inner pipe 31*d* are now arranged in a front region thereof. Furthermore, further exhaust gas through-openings 32 are provided in a rear region of the inner pipe 31*d*.

The bypass body 18*d* predetermines a flow channel 7*d*, which is, for example, meandering. The flow chambers 20*d* are again connected in series and extend parallel to the main flow direction 3. The adjustment body 8 is arranged in the inner pipe 31*d* adjacent to the flow chambers 20*d*. The adjustment body 8 is provided between the exhaust gas inlet opening 10 and the exhaust gas outlet opening 26 of the exhaust gas flow pipe 5. It is arranged approximately centrally between the openings 10, 26. The exhaust gas can thus be guided upstream of the adjustment body 8 through the exhaust gas through-openings 32 from the inner pipe 31*d* into the adjacent, second expansion chamber. Downstream of the adjustment body 8, the exhaust gas can then be returned again into the inner pipe 31*d* via the corresponding exhaust gas through-openings 32. When the silencer 1*d* is configured as the rear silencer, the exhaust gas is then guided via the exhaust gas outlet opening 26 into the surroundings. When the silencer 1*d* is configured as a middle silencer, the exhaust gas is guided into at least one further silencer or pot.

If the adjustment body 8 according to FIG. 12 is in its closed position, the exhaust gas flows via the front, peripheral exhaust gas through-openings 32 into the bypass body 18*d*. In the first flow chamber 20*d*, the exhaust gas flows in the main flow direction 3. After the first flow chamber 20*d*, the exhaust gas is then returned counter to the main flow direction 3. It then enters at least one further flow chamber 20*d* and arrives via the rear, peripheral exhaust gas through-openings 32 in the inner pipe 31*d* again. The exhaust gas thus runs around the adjustment body 8 via the bypass body 18*d*.

If the adjustment body 8 according to FIG. 13 is in its open position, the exhaust gas can flow round or pass the latter. The exhaust gas then leaves the exhaust gas flow pipe 5 via the exhaust gas outlet opening 26 thereof. In contrast to the previous embodiments, the exhaust gas always flows through the exhaust gas outlet opening 26. The exhaust gas through-openings 32 form the exhaust gas outlet openings of the bypass channel 7*d* here.

Figure 12A:
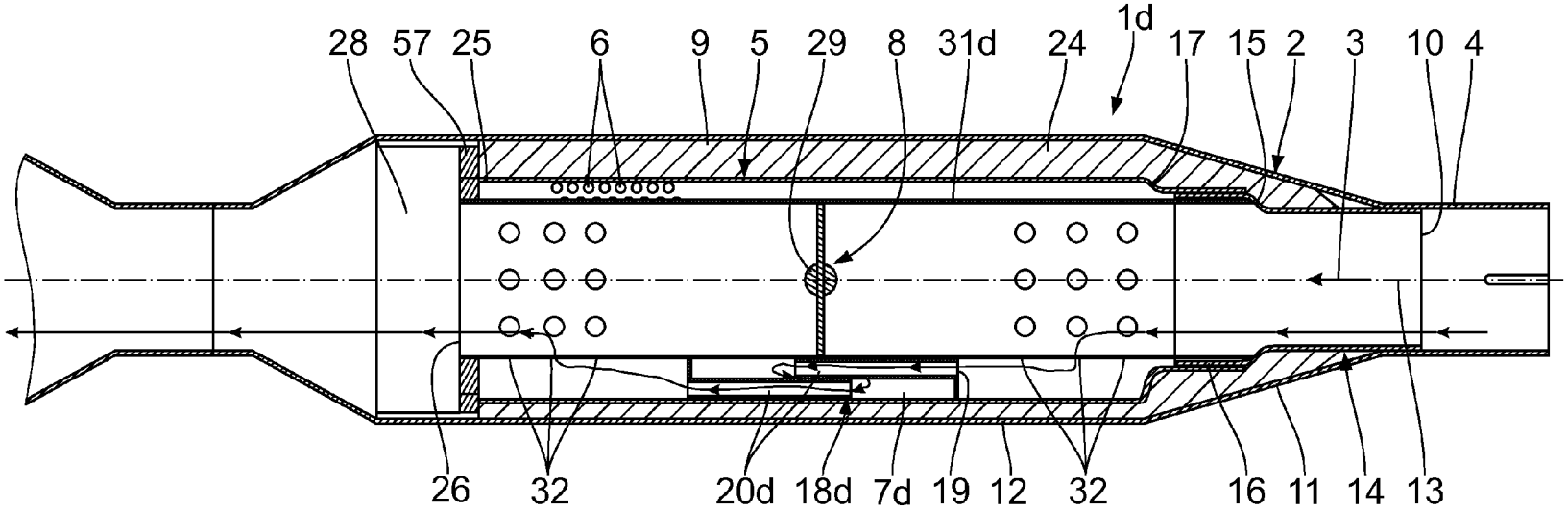
FIG. 12*a* is a longitudinal sectional view through the silencer substantially shown in FIG. 12, the silencer being able to be a middle silencer or a rear silencer.

According to FIG. 12*a*, a connecting piece is also associated with the silencer 1*d* according to FIGS. 12, 13 in order to be able to attach said silencer to any desired downstream silencer. It should be noted again here that all the silencers disclosed in this application may be rear or middle silencers. FIG. 12*a* shows by way of example how an attachment as a middle silencer can appear. This attachment is possible for all disclosed near silencers.

With reference to FIGS. 14 to 17, a fifth embodiment of the invention will be described below. In contrast to the previous embodiments, the silencer housing 2*e* is substantially oval in cross-section here. A silencing takes place in the silencer 1*e* by means of reflection and resonance.

The silencer 1*e* has a connection piece 4*e*, which is circular ring-shaped in cross-section.

The silencer housing 2*e* widens irregularly over the widening region 11*e*. The silencer housing 2*e* runs substantially further downward than upward from the connection piece 4*e*, so the connection piece 4*e* is located in an upper region of the silencer housing 2*e*.

The exhaust gas flow pipe 5*e*, which initially widens downwardly from the connection piece 4*e* in the main flow direction 3, furthermore adjoins the connection piece 4*e*. Perforation openings 6 are provided in the exhaust gas flow pipe 5*e*, at least in an upstream region of the exhaust gas flow pipe 5*e*.

Provided between the silencer housing 2*e* and the exhaust gas flow pipe 5*e* is the intermediate space 24*e*, which can be filled with absorption material 9 and is peripherally closed.

The intermediate space 24*e* and the exhaust gas flow pipe 5*e* are closed at their downstream end by a closure plate 34, which extends perpendicular to the main flow direction 3. An exhaust gas outlet opening 26, which, in the main flow direction 3, opposes the connection piece 4*e*, is configured in the closure plate 34. Arranged downstream of the exhaust gas outlet opening 26 is the adjustment body receiver 27, in which the adjustment body 8 is pivotably mounted.

The bypass body 18*e* is for the most part located in the exhaust gas flow pipe 5*e*. In its upstream region 35, it has a plurality of exhaust gas inlet openings 19. The bypass body 18*e* is tubular. It preferably has a circular ring-shaped cross-section. The bypass body 18*e* passes through the closure plate 34 adjacent to the adjustment body receiver 27. The upstream region 35 is surrounded by a cap body 36, which has a closed head region 37. Furthermore, the cap body 36 has an open foot region 38, which is arranged opposing the head region 37. The foot region 38 is provided downstream of the head region 37 in the main flow direction 3. The bypass body 18*e* ex-tends parallel to the main flow direction 3 of the exhaust gas flow pipe 5*e*.

An exhaust gas flow space 39, which is open toward the closure plate 34, is therefore present between the bypass body 18*e* and the cap body 36.

Figure 14:
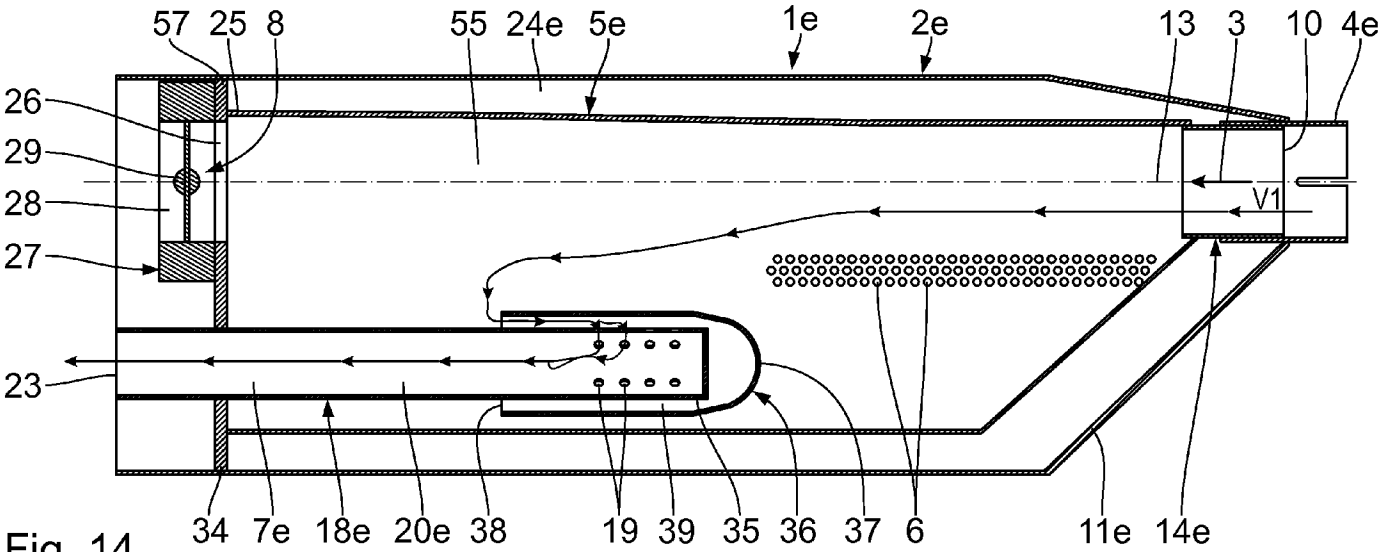
FIG. 14 is a longitudinal sectional view through a silencer according to the invention according to a fifth embodiment, the adjustment body being in a closed position here.
Figure 15:
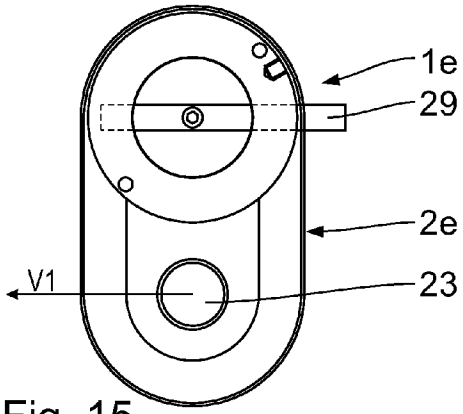
FIG. 15 is a schematic view which shows the silencer shown in FIG. 14 from behind.

If the adjustment body 8 according to FIGS. 14, 15 is in its closed position, the exhaust gas flows out of the connection piece 4*e* via the foot region 38 into the exhaust gas flow space 39 and enters the bypass body 18*e* there via the exhaust gas inlet openings 19. In the exhaust gas flow space 39, the exhaust gas flows from the foot region 38 counter to the main flow direction 3 to the exhaust gas inlet openings 19. The exhaust gas flows here transverse to the main flow direction 3. It then leaves the bypass body 18*e* via its exhaust gas outlet opening 23.

Figure 16:
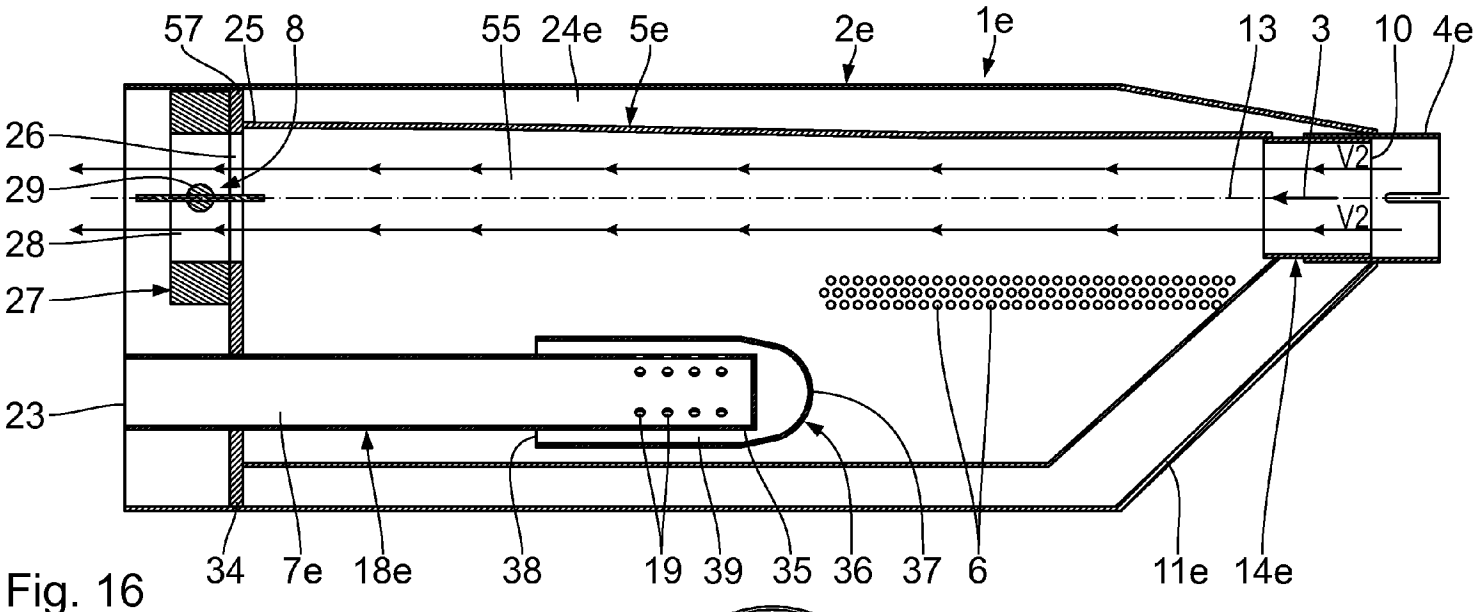
FIG. 16 is a longitudinal sectional view of the silencer shown in FIG. 14, the adjustment body being in an open position.
Figure 17:
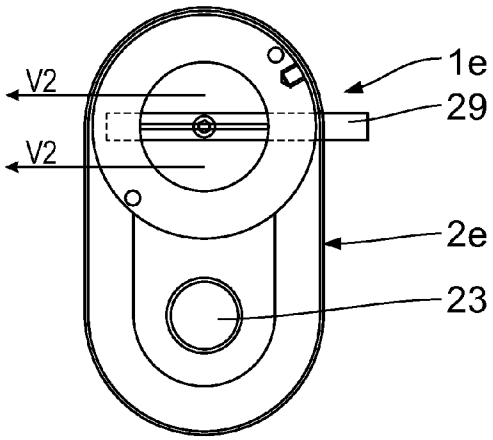
FIG. 17 is a schematic view which shows the silencer shown in FIG. 16 from the rear.

If the adjustment body 8 according to FIGS. 16, 17 is in its open position, the exhaust gas flows through the exhaust gas flow pipe 5*e* to the exhaust gas outlet opening 26. The exhaust gas expands here in the exhaust gas flow pipe 5*e* and is then brought together again.

A sixth embodiment of the invention will be described below with reference to FIGS. 18 and 19. Compared with the fifth embodiment, an exhaust gas guide element 40 is inserted in the exhaust gas flow pipe 5*f* here. The exhaust gas guide element 40 runs from the connection piece 4*f* straight to the closure plate 34 and is fastened thereto adjacent to the exhaust gas out-let opening 26. The exhaust gas guide element 40 is preferably arcuately curved in cross-section. Exhaust gas through-openings 32, which are provided at the level of the cap body 36, are configured in the exhaust gas guide element 40. The adjustment body 8 is arranged downstream of the exhaust gas guide element 40. All possible types of damping are possible.

Figure 18:
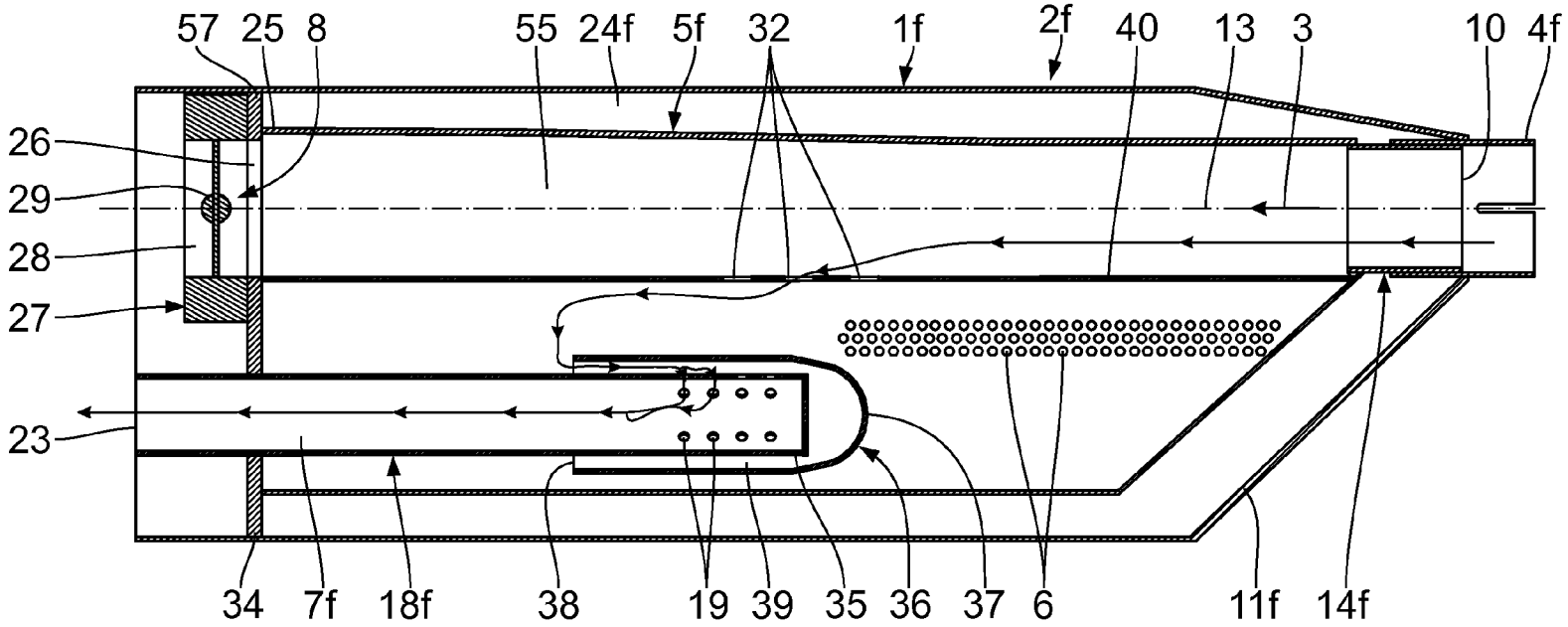
FIG. 18 is a longitudinal sectional view through a silencer according to the invention according to a sixth embodiment, the adjustment body being in a closed position here.

If the adjustment body 8 according to FIG. 18 is in its closed position, the exhaust gas flows via the exhaust gas through-openings 32 into the exhaust gas flow space 39. It enters the latter via the foot region 38 and then flows counter to the main flow direction 3 to the exhaust gas inlet openings 19. The exhaust gas through-openings 32 maybe distributed over the entire periphery of the exhaust gas flow pipe 5*f*. However, only precisely one exhaust gas through-opening 32 may also be present.

Figure 19:
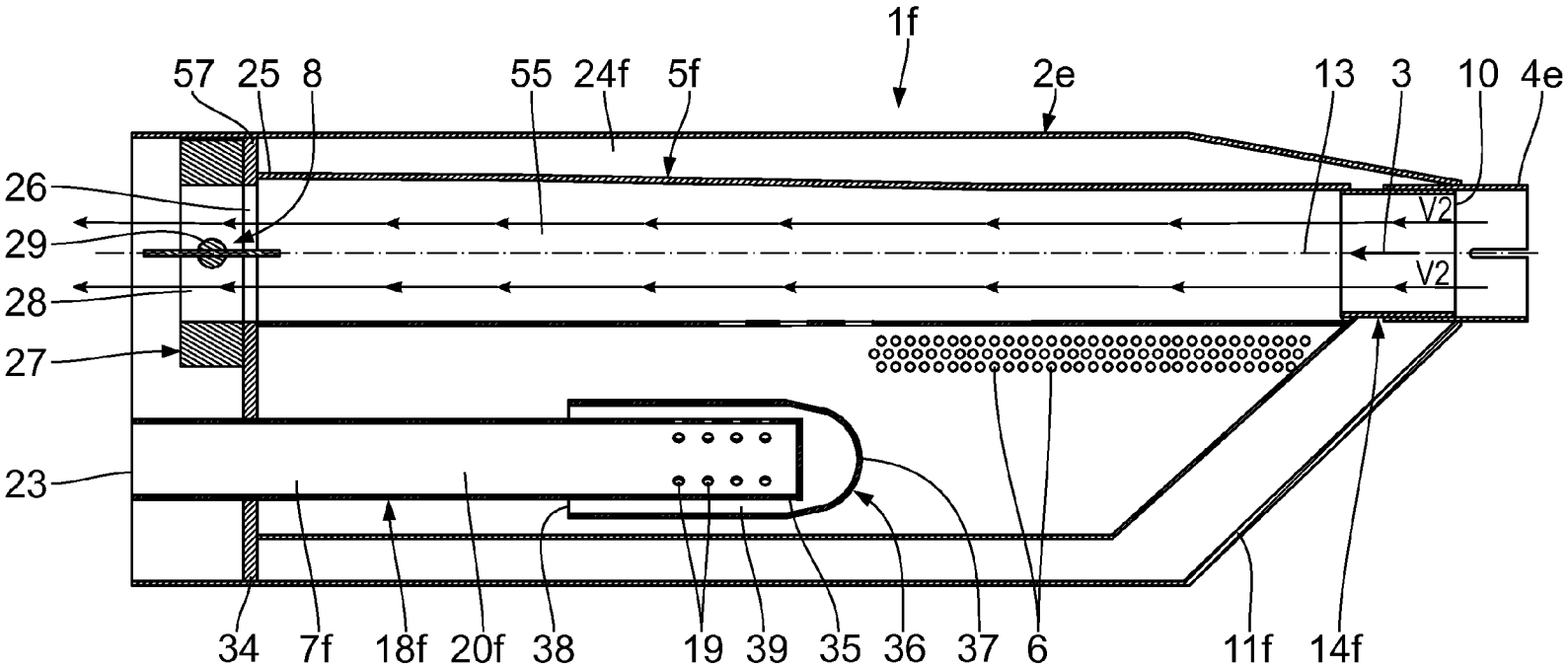
FIG. 19 is a longitudinal sectional view of the silencer shown in FIG. 18, the adjustment body being in an open position.

When the adjustment body 8 according to FIG. 19 is in its open position, the exhaust gas flows straight out of the connection piece 4*f* via the exhaust gas outlet opening 26 through the freed exhaust gas through-channel 28.

Figure 20:
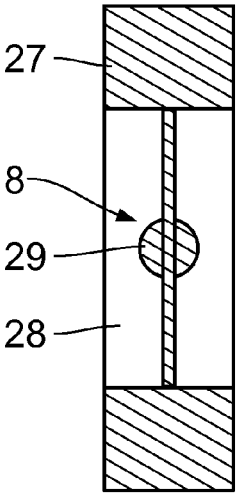
FIG. 20 is a sectional view of an adjustment body in a closed position and an associated adjustment body receiver.
Figure 21:
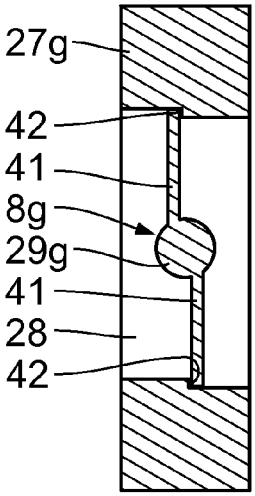
FIG. 21 is a sectional view of an adjustment body in a closed position and an associated adjustment body receiver.
Figure 22:
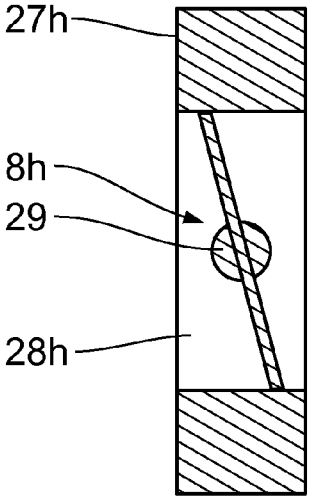
FIG. 22 is a sectional view of an adjustment body in a closed position and an associated adjustment body receiver.

Referring to FIGS. 20 to 22, various adjustment bodies 8 and different adjustment body receivers 27 are shown.

The adjustment body 8 and the adjustment body receiver 27 according to FIG. 20 correspond to the adjustment body 8 already described or the adjustment body receiver 27 already described. It is to be noted here that the exhaust gas outlet body 22 passing through the adjustment body receivers 27 in the embodiments according to FIGS. 1, 3, 5, 7, 10 and 11 is not shown in FIGS. 20 to 22 for reasons of clarity.

According to FIG. 21, the adjustment body 8*g* has an upper and a lower adjustment body region 41. These run parallel to one another. The adjustment body regions 41 are, however, arranged offset with respect to one another on the bearing body 29*g*. Two end stops 42, which are formed by corresponding shoulders in the adjustment body receiver 27*g*, are configured in the adjustment body receiver 27*g*. The end stops 42 run substantially perpendicular to the main flow direction 3. They have a direct connection to the exhaust gas through-channel 28. A recess extends in the main flow direction 3 from the upper end stop 42. A corresponding recess extends counter to the main flow direction 3 from the lower end stop 42. The end stops 42 are offset with respect to one another in the main flow direction 3.

When the adjustment body 8*g* is in its closed position, the outer adjustment body regions 41 rest laterally on the end stops 42. The end stops 42 prevent the adjustment body 8*g* being pivotable beyond its closed position.

Figure 21A:
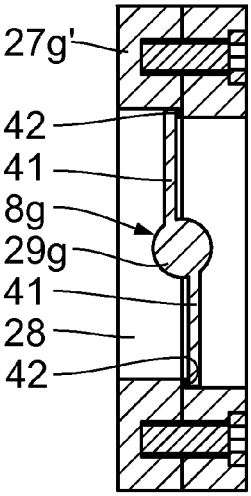
FIG. 21*b* is a sectional view of an adjustment body in a closed position and an associated adjustment body receiver.

According to FIG. 21*a*, the adjustment body receiver 27*g*' is in two parts. The adjustment body receiver 27*g*' therefore has a first adjustment body receiver part and a second adjustment body receiver part, which rest on one another on the end face and are rigidly connected to one another. The adjustment body receiver parts together limit the exhaust gas through-channel 28. End stops 42 are provided again.

Figure 21B:
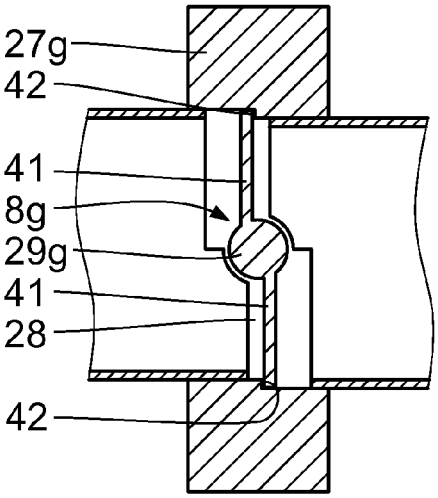

According to FIG. 21*b*, the adjustment body receiver 27 is configured in accordance with FIG. 21. Two separate pipes, which end spaced apart from the end stops 42, are introduced into the adjustment body receiver 27*g*.

According to FIG. 22, the adjustment body 8*h* is oval. The adjustment body 8*h* therefore has a main axis and a subsidiary axis, which is smaller than the main axis. The exhaust gas through-channel 28*h* in the adjustment body receiver 27*h* is round in cross-section and dimensioned in such a way that the pivoting of the adjustment body 8*h* is limited. The wall limiting the exhaust gas through-channel 28*h* therefore forms an end stop 42 for the adjustment body 8*h*.

A seventh embodiment of the invention will be described below with reference to FIGS. 23 to 26. The principle structure of the silencer 1*i* corresponds to the silencer 1 shown in FIGS. 1 to 4. A bypass body 18*i*, which is tubular and runs straight along the exhaust gas flow pipe 5*i* on the inside, is inserted here in the exhaust gas flow pipe 5*i*. The exhaust gas inlet opening 19 of the bypass body 18*i* is located here in the exhaust gas flow pipe 5*i*. It is located in the exhaust gas flow pipe 5*i* between, preferably approximately centrally between, the exhaust gas inlet opening 10 and the exhaust gas outlet opening 26*i*. The longitudinal center axis of the bypass body 18*i* thus runs offset with respect to the longitudinal center axis 13 of the silencer housing 2*i*. The exhaust gas outlet body 22 runs past the adjustment body 8*i*. The adjustment body 8*i* is configured as an adjustment flap here, which is pivotably mounted in the adjustment body receiver 27*i*. The adjustment body 8*i* is substantially formed by a semi-circular plate, which is pivotably mounted on a bearing body 29*i*. The bearing body 29*i* is configured as a bearing pin, which extends in the main flow direction 3. The bearing body 29*i* furthermore has a direct connection to a closure plate 34*i*, which closes the exhaust gas flow pipe 5*i* at the end. The closure plate 34*i* has a corresponding recess in the region of the exhaust gas outlet body 22.

A gear rim 43 is provided on the adjustment body 8*i* on its curved region at the edge. The gear rim 43 has a large number of teeth 44. The silencer 1*i* furthermore comprises a drive gear wheel 45, which can be driven to rotate and meshes with a transmission gear wheel 46. The transmission gear wheel 46 furthermore meshes with the gear rim 43. A gear wheel control is therefore virtually present. The gear rim 43 can alternatively also be driven directly by a drive gear wheel, which then has a direct tooth connection with the gear rim 43.

Figure 23:
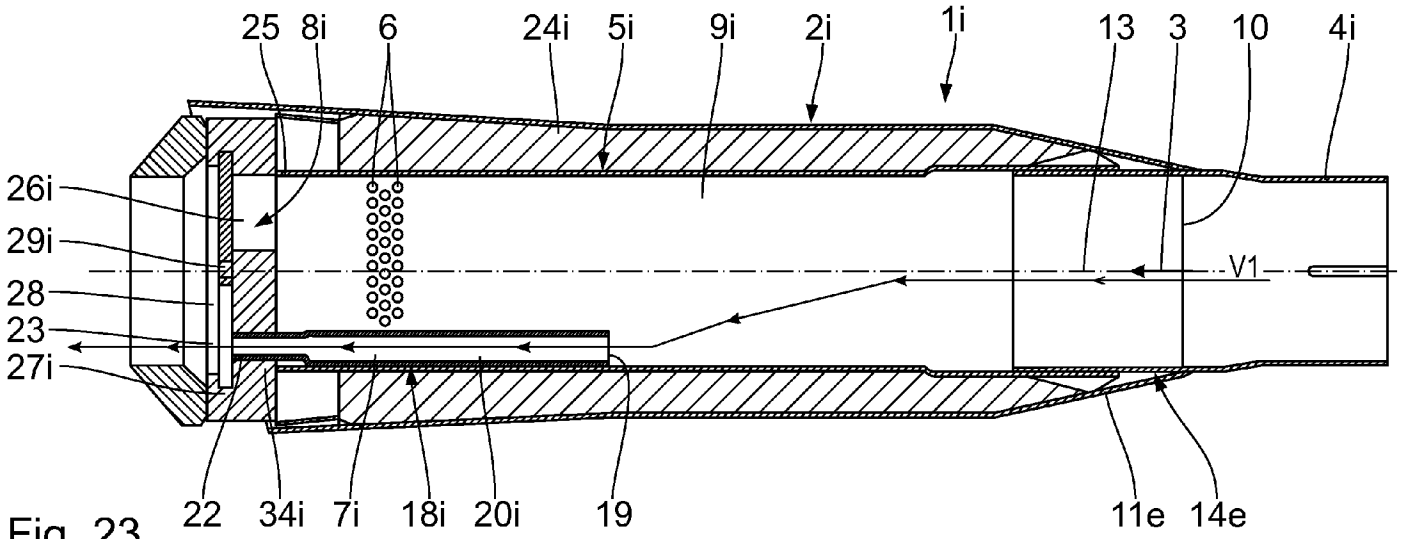
FIG. 23 is a longitudinal sectional view through a silencer according to the invention according to seventh embodiment, the adjustment body being in a closed position.
Figure 24:
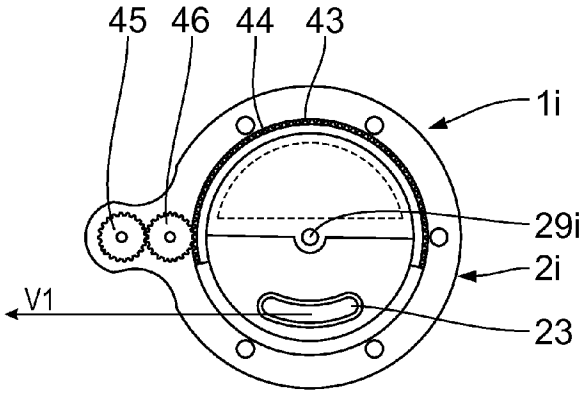
FIG. 24 is a schematic view which shows the silencer shown in FIG. 23 from the rear.
Figure 25:
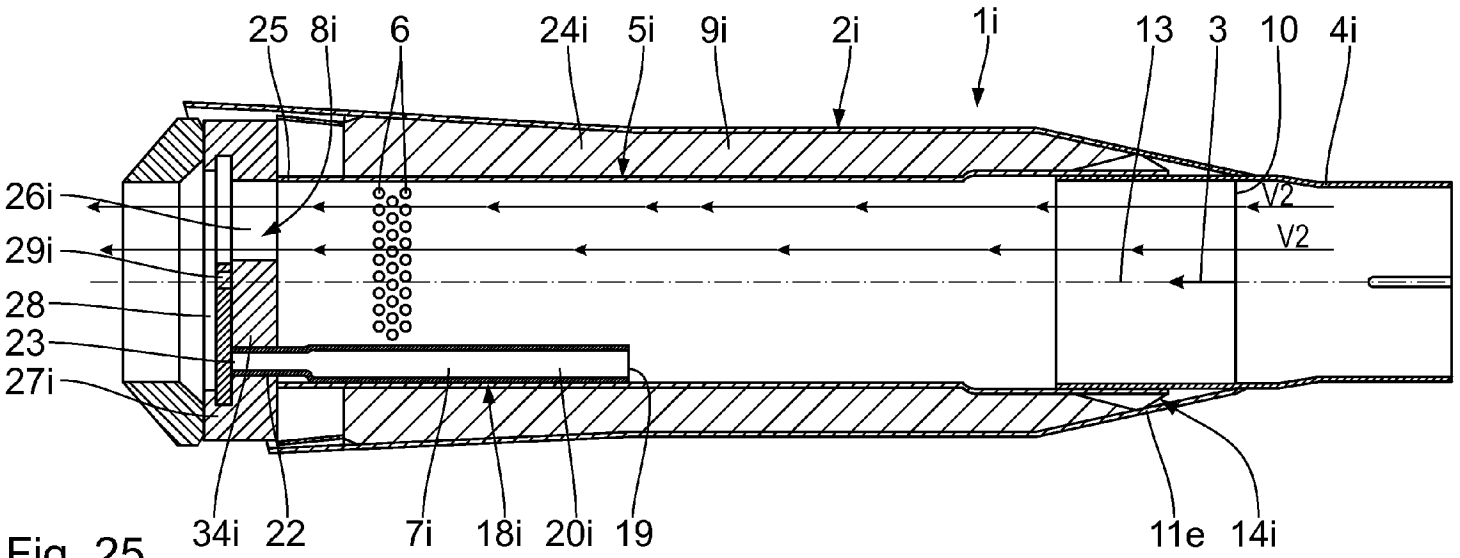
FIG. 25 is a longitudinal sectional view of the silencer shown in FIG. 23, the adjustment body being in an open position.
Figure 26:
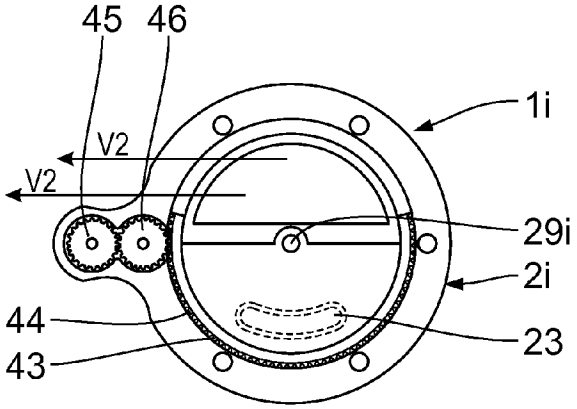
FIG. 26 is a schematic view which shows the silencer shown in FIG. 25 from the rear.

When the adjustment body 8*i* is in its closed position according to FIGS. 23, 24, the exhaust gas flows via the bypass body 18*i* past the adjustment body 8*i*.

The transmission gear wheel 46 is also made to rotate by the rotary drive of the drive gear wheel 45. The rotary movement of the transmission gear wheel 46 brings about a pivoting of the adjustment body 8*i* and the bearing body 29*i*. When the adjustment body 8*i* is in its open position according to FIGS. 25, 26, the exhaust gas outlet opening 26*i* is freed, so the exhaust gas can flow through it. The bypass channel 7*i* is closed here by the adjustment body 8*i*.

Figure 27:
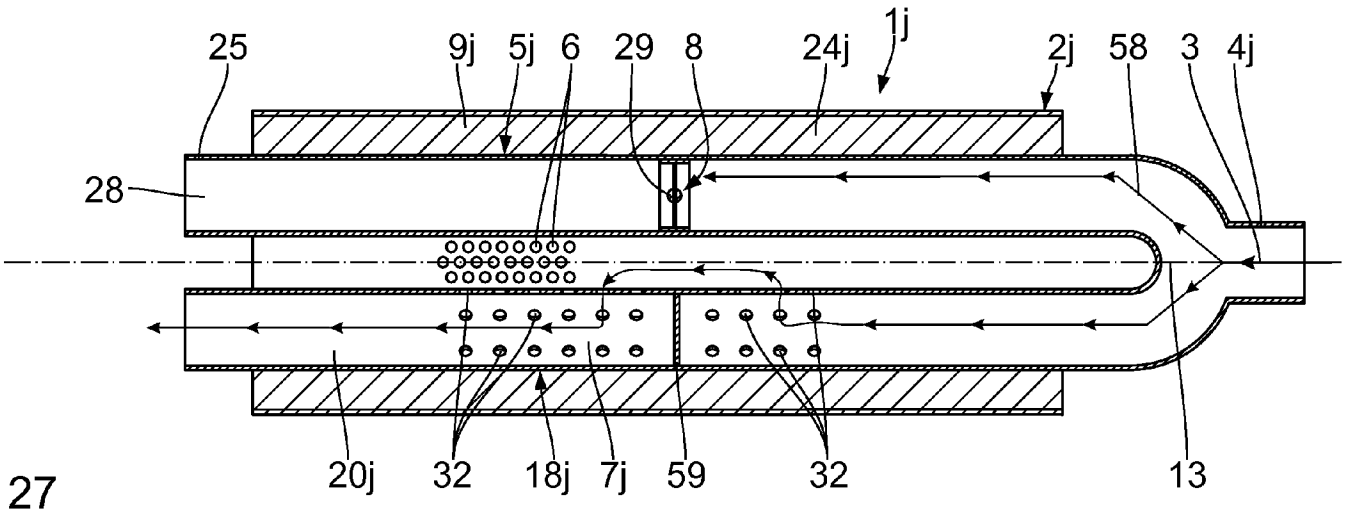
FIG. 27 is a longitudinal sectional view through a silencer according to the invention shown in a simplified manner according to an eighth embodiment, the adjustment body being in a closed position.

According to FIG. 27, provided upstream of the exhaust gas flow pipe 5*j* and the bypass body 18*j* is a coupling pipe section 58, by means of which the exhaust gas flow pipe 5*j* and the bypass body 18*j* have a flow connection to one another. An adjustment body 8 is arranged in the exhaust gas flow pipe 5*j*.

On the other hand, at least one partition wall 59, which closes the bypass channel 7*j*, is arranged in the bypass body 18*j*. Upstream and downstream of the partition wall 59, lateral exhaust gas through-openings 32 are arranged in the bypass body 18*j*.

When the adjustment body 8 is in its closed position, the exhaust gas flows via the upstream exhaust gas through-openings 32 out of the bypass channel 7*j* and flows via the downstream exhaust gas through-openings 32 back into the bypass channel 7*j*. In this case, the exhaust gas flows via an outer flow chamber past the partition element 59.

When the adjustment body 8 is in its open position, exhaust gas can flow around it. The exhaust gas then passes the adjustment body 8.

Figure 28:
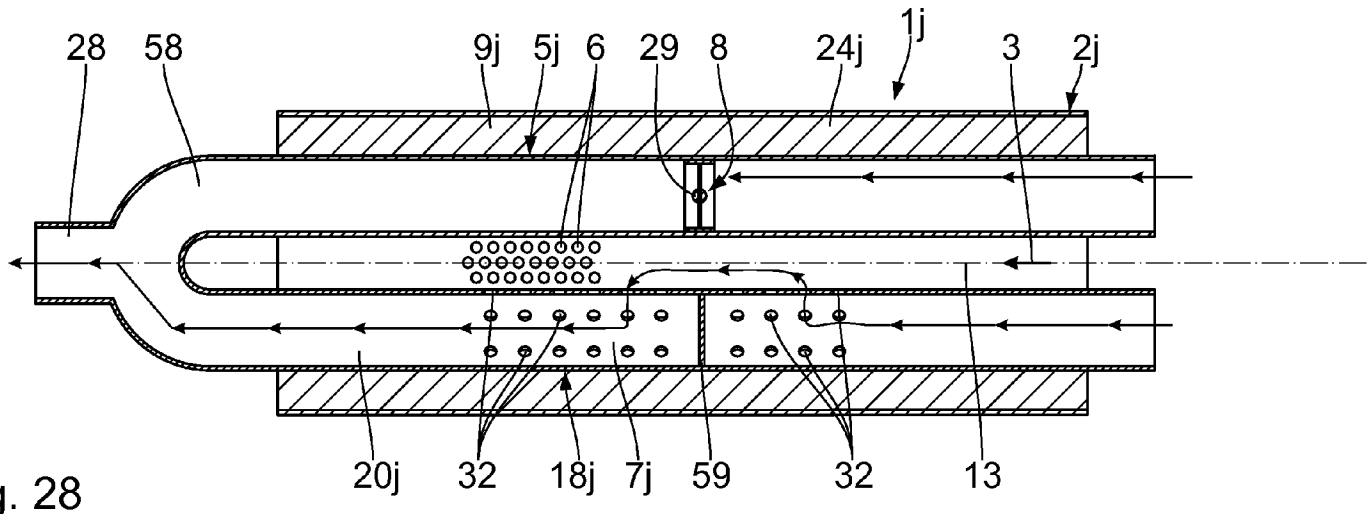
FIG. 28 is a longitudinal section view through a silencer according to the invention in a simplified manner according to a ninth embodiment, the adjustment body being in a closed position.

The embodiment according to FIG. 28 differs in relation to the embodiment of FIG. 27 in that the coupling pipe section 58 is arranged downstream of the exhaust gas flow pipe 5*j* and the bypass body 18*j*.

Figure 29:
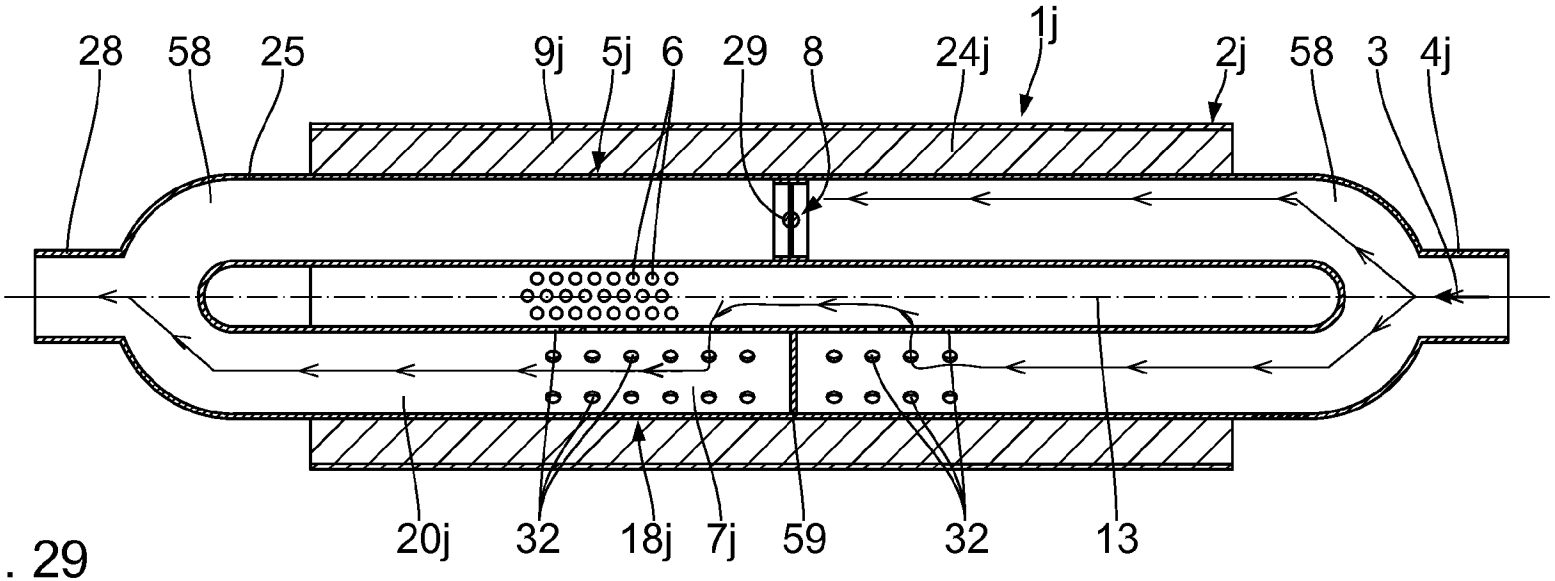
FIG. 29 is a longitudinal sectional view through a silencer according to the invention shown in a simplified manner according to a tenth embodiment, the adjustment body being in a closed position.

According to FIG. 29, coupling pipe sections 58 are arranged downstream and upstream of exhaust gas flow pipe 5*j* and the bypass body 18*j*.

Figure 30:
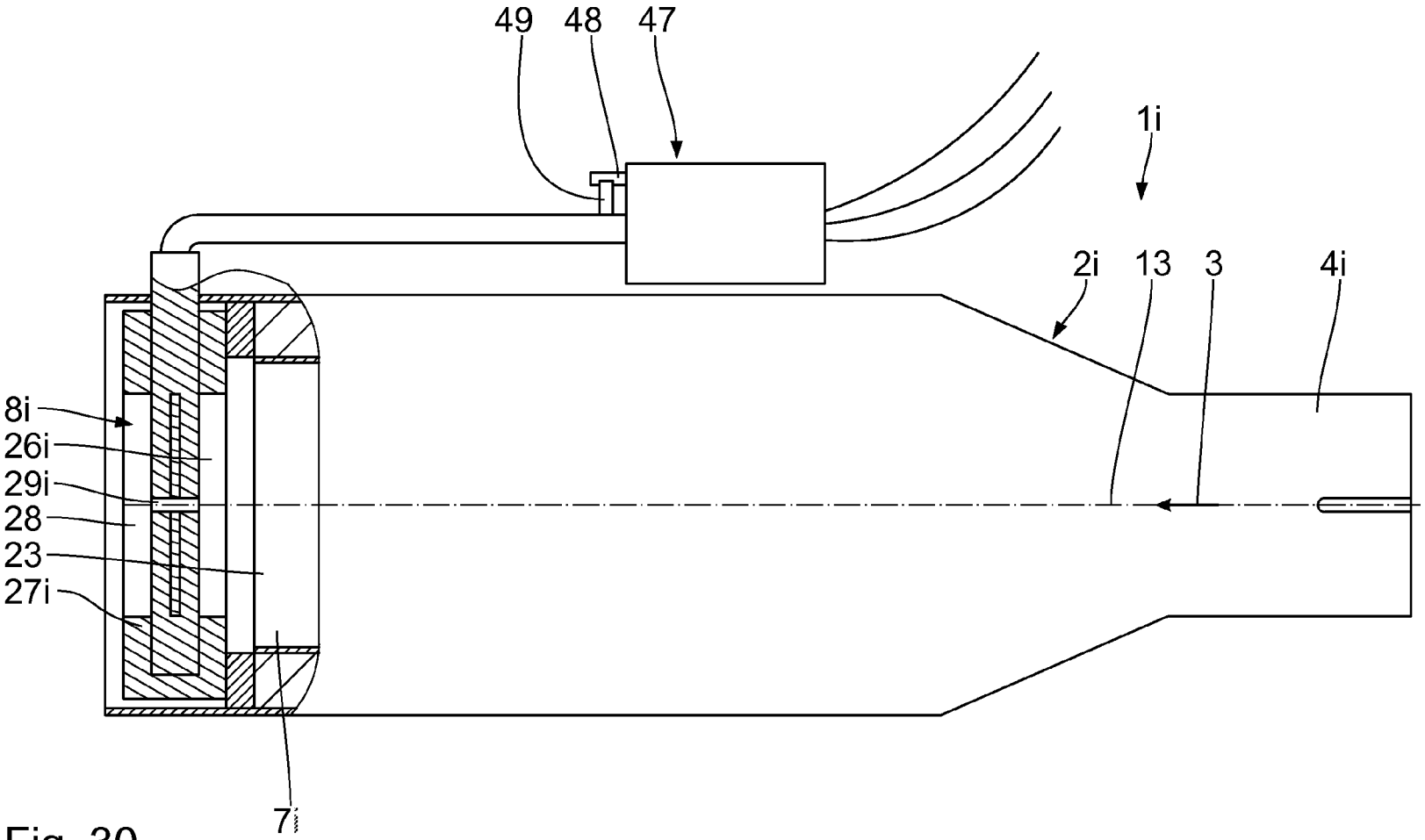
FIG. 30 is a schematic, partly sectional, view of a silencer arrangement according to the invention according to a further embodiment, an activation of an adjustment body by means of an adjustment motor connected to the adjustment body being illustrated by way of example.
Figure 31:
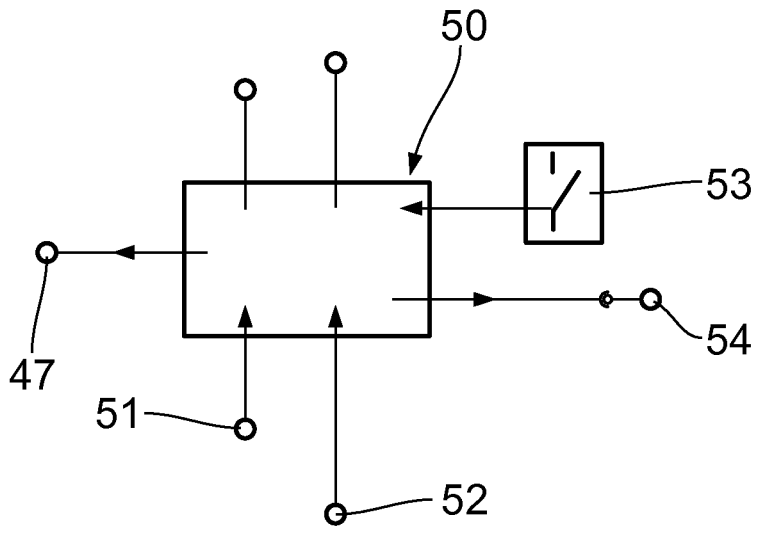
FIG. 31 is a simplified schematic view which shows the control device and the lines or components connected thereto.

FIG. 30 by way of example shows a silencer 1*i* with an actuator 47, which is preferably an electric actuator or a servomotor or a different direct current motor. The actuator 47 has a drive shaft (not shown), which has an operative connection to the adjustment body 8*i* to actuate it. Furthermore, the actuator 47 comprises an end stop 48. The end stop 48 is preferably stationarily attached to the housing of the actuator 47. It can interact with an entrainer 49, which is fastened to the drive shaft. When the entrainer 49 comes to rest on the end stop 48, the current of the actuator 47 increases. This is then recognized by a control device, which is shown in simplified form in FIG. 31 and has the reference numeral 50. The control device 50 has a connection to the actuator 47 so as to transmit data. The end stop 48 may, however, also be formed by the specific design of the adjustment body 8, 8*g*, 8*h* (see FIGS. 21, 21*a*, 21*b*, 22). The required adjustment angles for the adjustment body 8*i* can, however, also be electronically produced by a servomotor without mechanical stops.

The control device 50 receives motor vehicle movement data. A first sensor 51, which detects the driving speed of the motor vehicle, is connected to the control device 50. Optionally, a second sensor 52 may be connected to the control device 50 and record the rotational speed of the combustion engine of the motor vehicle, the respective gear and/or other suitable values or signals of the motor vehicle. The rotational speed can be taken off inductively or conventionally. The actuator may be arranged at any point of the motor vehicle.

Furthermore, a momentary contact switch 53 is connected to the control device 50 and is used to manually switch the speed-dependent and/or rotational speed-dependent and/or gear-dependent automatic system of the control device 50 on or off. In particular, the momentary contact switch 53 is only used to activate/switch on or deactivate/switch off the speed-dependent, rotational speed-dependent and/or gear-dependent automatic system of the control device 50. During "deactivation" the adjustment body 8*i* remains in its closed position and the exhaust gas can only escape by means of the bypass channel at every speed or rotational speed and in all the gears.

The connection between the actuator 47 and the adjustment body 8 can be effected by means of a pliable shaft, a flexible or rigid Bowden cable, a worm gear, bevel gears, conventional gear wheels, tooth connections, a V-belt, a chain drive, a universal joint or Cardan shaft, lever transmissions, a linkage, a screw thread or a threaded rod. The connection mentioned may be spring-assisted or non-spring-assisted.

Furthermore, an exhaust test sensing device 54 is connected to the control device 50. This sensing device is used to completely switch off the control device 50. A test mode in the control device 50, which makes it possible to check the adjustment body 8*i* without having to drive, can be activated using the separate exhaust test sensing device 54. By actuating the exhaust test sensing device 54, the ability of the silencer arrangement to function after attachment to the motor vehicle or for maintenance work can be tested.

Figure 32:
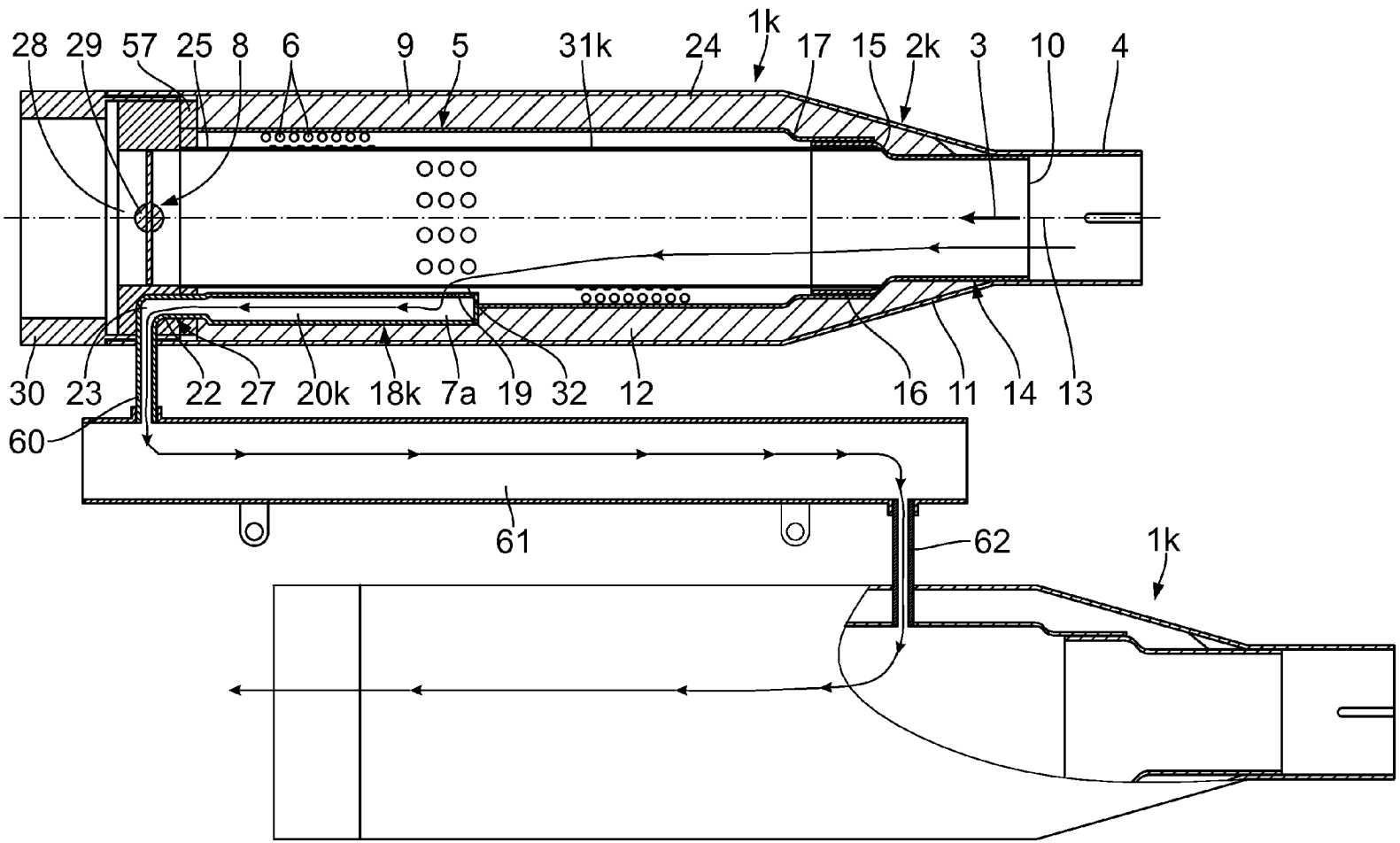
FIG. 32 is a schematic, partly sectional, view of a silencer arrangement according to the invention according to a further embodiment.

According to FIG. 32, two silencers 1*k* are virtually connected in series. For this purpose, the bypass body 18*k* laterally has a downstream outlet piece 60, which opens into an interference pipe 61 on the inlet side. The interference pipe 61 is preferably configured as an exhaust pipe holder. The interference pipe 61 for this purpose has at least one fastening means for fastening to the vehicle. A coupling pipe 62, which leads into a further silencer 1*k*, is attached to the downstream end of the interference pipe 61.

Figure 33:
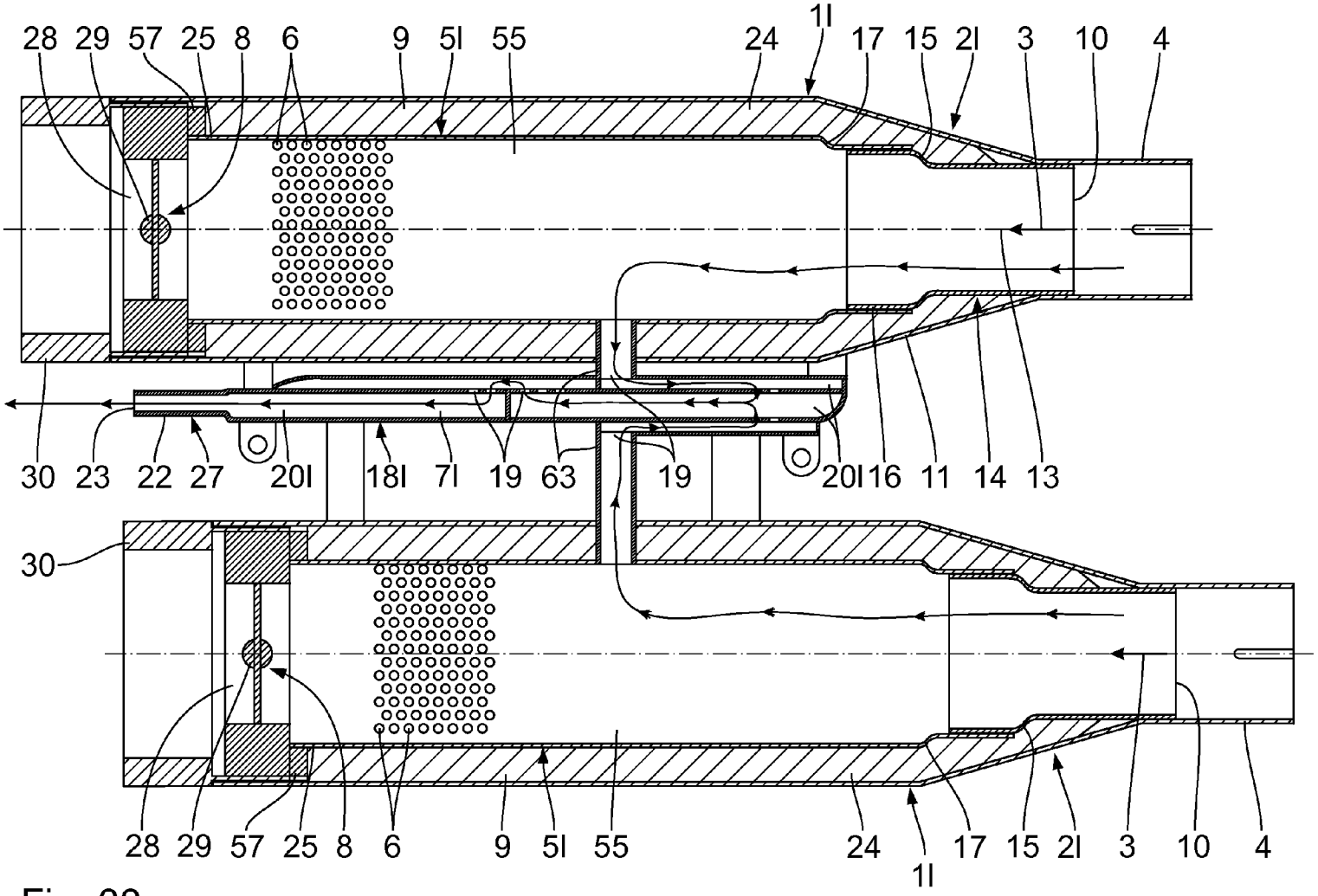
FIG. 33 is a schematic view of a silencer arrangement according to the invention according to a further embodiment.

According to FIG. 33, two silencers 1*l* are provided, which have a flow connection to a common, external bypass body 181. For this purpose, peripheral connection bodies 63 are arranged in the exhaust gas flow pipes 51 and open laterally into the bypass body 181. The exhaust gas is repeatedly deflected in the bypass body 181. For this purpose, corresponding openings are provided in guide walls, which are arranged in the bypass body 181.

It is advantageous if the external bypass body 181 is configured as an exhaust pipe holder. For this purpose, the bypass body 181 preferably has at least one fastening means for fastening to the vehicle.

Figure 34:
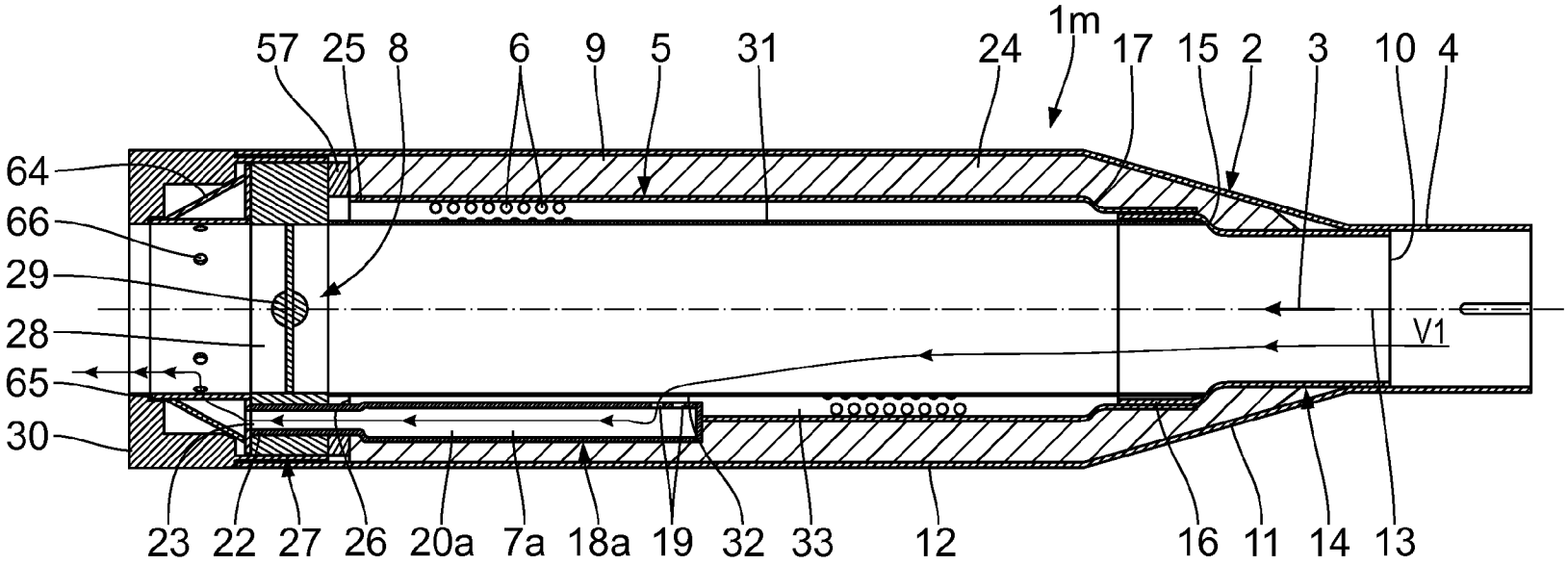
FIG. 34 is a longitudinal sectional view through a silencer according to the invention according to a last embodiment, the adjustment body being in its closed position.

The alternative silencer 1*m* shown in FIG. 34 is similar to the silencer 1*c* according to FIGS. 10, 11. Reference is made to the description pertaining to this. In contrast to the silencer 1*c*, the silencer 1*m* downstream of the exhaust gas outlet opening 23 has a hollow throttle body 64, which is arranged in the end piece 30 and brings together the exhaust gas leaving the exhaust gas outlet opening 23. The exhaust gas, after the exhaust gas outlet opening 23, thus flows, during operation, toward the longitudinal center axis 13. It is thus deflected again. The throttle body 64 furthermore has an inner pipe casing 65, which is mainly used to guide the exhaust gas passing the adjustment body 8. In the pipe casing 65, at least one through-opening 66 is configured, by means of which the exhaust gas from the exhaust gas outlet opening 23 can enter an end channel limited by the pipe casing 65. The gas passing the adjustment body 8 also enters the end channel when the adjustment body 8 is open. The exhaust gas arrives in the surroundings via the end channel.

Individual parts of the embodiments described here can be combined with one another as desired if this is expedient. In particular, the bypass bodies can be exchanged. The position and configuration of the adjustment bodies can also be exchanged.

While specific embodiments of the invention have been shown and described in detail to illustrate the application of the principles of the invention, it will be understood that the invention may be embodied otherwise without departing from such principles.

The invention claimed is:

1. A silencer for exhaust systems of motor vehicles with an internal combustion engine, the silencer comprising:

an exhaust gas flow pipe for guiding exhaust gas with at least one exhaust gas inlet opening, at least one exhaust gas outlet opening, which has a flow connection to the at least one exhaust gas inlet opening, and a longitudinal center axis;

at least one actuable adjustment body to influence a flow of the exhaust gas in the exhaust gas flow pipe, wherein the at least one actuable adjustment body is arranged downstream of the at least one exhaust gas inlet opening, and said at least one actuable adjustment body is movable between an open position and a closed position, said at least one actuable adjustment body being mounted in an adjustment body receiver; and at least one bypass channel defined by a bypass body, which has a flow connection to the exhaust gas flow pipe, and said at least one bypass channel has at least one exhaust gas outlet opening, said bypass body being a separate insert from said exhaust gas flow pipe, at least a portion of said bypass body extending through said adjustment body receiver.

2. The silencer according to claim 1, wherein the at least one actuable adjustment body is arranged directly downstream of the exhaust gas flow pipe, said at least one bypass channel being defined exclusively by said bypass body.

3. The silencer according to claim 1, wherein the exhaust gas flow pipe is configured in such a way that the exhaust gas can flow straight through the exhaust gas flow pipe in a direction of the longitudinal center axis if the at least one actuable adjustment body is in said open position.

4. The silencer according to claim 1, further comprising:

at least one exhaust gas guide element, which is arranged in the exhaust gas flow pipe and extends at least partially along said exhaust gas flow pipe and which has at least one exhaust gas through-opening and limits at least one outer expansion chamber.

5. The silencer according to claim 1, wherein at least one exhaust gas inlet opening of a bypass body is covered, at least in regions, by at least one cap body arranged spaced apart.

6. A silencer arrangement for exhaust systems of motor vehicles with an internal combustion engine, comprising at least one silencer, the at least one silencer comprising:

an exhaust gas flow pipe for guiding exhaust gas with at least one exhaust gas inlet opening, at least one exhaust gas outlet opening, which has a flow connection to the at least one exhaust gas inlet opening, and a longitudinal center axis;

an adjustment body receiver comprising a bypass body opening;

at least one actuable adjustment body to influence a flow of the exhaust gas in the exhaust gas flow pipe, said at least one actuable adjustment body being connected to said adjustment body receiver, wherein the at least one actuable adjustment body is arranged downstream of the at least one exhaust gas inlet opening, and said at least one actuable adjustment body is movable between an open position and a closed position; and a bypass body comprising at least one bypass channel, which has a flow connection to the exhaust gas flow pipe, and said at least one bypass channel has at least one exhaust gas outlet opening, said bypass body opening receiving at least a portion of said bypass body, said bypass body being a separate and distinct insert structure from said exhaust gas flow pipe.

7. The silencer arrangement according to claim 6, further comprising:

a control device, which has a connection, so as to transmit data, to the at least one actuable adjustment body for the actuation thereof; and at least one adjustment drive, which can be actuated by the control device, to adjust the at least one actuable adjustment body, wherein said at least one bypass channel is defined exclusively by said bypass body.

8. The silencer arrangement according to claim 6, further comprising:

another silencer to provide at least two silencers, said at least two silencers being connected in parallel.

9. The silencer arrangement according to claim 7, wherein the control device is configured in such a way that when at least one threshold value is preset, said control device actuates the at least one adjustment drive in such a way that the at least one actuable adjustment body only opens to reduce an exhaust gas counter-pressure to such an extent that predetermined vehicle values are retained.

10. The silencer arrangement according to claim 7, wherein an exhaust test sensing device, which is used to completely switch off the control device, is connected to the control device.

11. The silencer arrangement according to claim 7, wherein a momentary contact switch, which is only used to one of activate/switch on and deactivate/switch off at least one of a speed-dependent and a rotational speed-dependent automatic system of the control device, is connected to the control device.

12. The silencer according to claim 1, wherein the at least one actuable adjustment body is accommodated so as to be actuable in an exhaust gas through-channel, which is limited by an adjustment body receiver, wherein the adjustment body receiver is configured in two parts and said adjustment body receiver has a first adjustment body receiver part and a second adjustment body receiver part, which rest on one another on an end face and are rigidly connected to one another.

13. The silencer according to claim 1, wherein the at least one actuable adjustment body is oval and has a main axis and a subsidiary axis, which is smaller than the main axis, an exhaust gas through-channel in an adjustment body receiver being round in cross-section and dimensioned in such a way that pivoting of the at least one actuable adjustment body is limited.

14. The silencer according to claim 1, further comprising:

at least one exhaust gas guide element, which is arranged in the exhaust gas flow pipe and extends at least partially along said exhaust gas flow pipe and which has at least one exhaust gas through-opening and limits at least one outer expansion chamber, wherein at least one bypass body extends, at least in regions, in the at least one outer expansion chamber.

15. The silencer arrangement according to claim 6, further comprising:

a control device, which has a connection, so as to transmit data, to the at least one actuable adjustment body for actuation thereof; and at least one adjustment drive, which can be actuated by the control device, to adjust the at least one actuable adjustment body, wherein the control device, depending on at least one preset threshold value, automatically actuates the at least one actuable adjustment body.

16. The silencer arrangement according to claim 15, wherein the control device, after a programmed-in switch-off time, receives a switch-off time signal to switch off the at least one adjustment drive.

17. The silencer arrangement according to claim 15, wherein an adjustment of the at least one actuable adjustment body is limited by at least one stop, the control device receiving a stop signal upon reaching the at least one stop.

18. The silencer arrangement according to claim 6, further comprising:

another silencer to provide at least two silencers, said at least two silencers being connected in parallel, at least two of the silencers having a flow connection to one another by means of at least one bypass channel.

19. The silencer arrangement according to claim 17, wherein the at least one actuable adjustment body is in said closed position when the motor vehicle is idling.

20. The silencer arrangement according to claim 7, wherein an exhaust test sensing device, which is used to completely switch off the control device, is connected to the control device, a test mode in the control device, which makes it possible to check the at least one actuable adjustment body without having to drive, being able to be activated using the exhaust test sensing device.

21. The silencer arrangement according to claim 7, wherein a momentary contact switch, which is only used to one of activate/switch on and deactivate/switch off at least one of a speed-dependent and a rotational speed-dependent automatic system of the control device, is connected to the control device, wherein, on deactivation, the at least one actuable adjustment body remains in said closed position and the exhaust gas, at one of every speed and rotational speed and in all the gears, can only escape by means of the bypass channel.

22. A silencer for exhaust systems of motor vehicles with an internal combustion engine, the silencer comprising:

an exhaust gas flow pipe for guiding exhaust gas with at least one exhaust gas inlet opening, at least one exhaust gas outlet opening, which has a flow connection to the at least one exhaust gas inlet opening, and a longitudinal center axis;

at least one actuable adjustment body to influence a flow of the exhaust gas in the exhaust gas flow pipe, wherein the at least one actuable adjustment body is arranged downstream of the at least one exhaust gas inlet opening, and said at least one actuable adjustment body is movable between an open position and a closed position; and a bypass body defining at least one bypass channel, said at least one bypass channel being in fluid communication with said exhaust gas flow pipe, said at least one bypass channel having at least one exhaust gas outlet opening, said bypass body being a separate and distinct insert from said exhaust gas flow pipe, said bypass body comprising a plurality of flow chambers.

* * * * *